US011828079B2

(12) United States Patent
Hageman

(10) Patent No.: US 11,828,079 B2
(45) Date of Patent: Nov. 28, 2023

(54) CONVERTIBLE POOL COVER SYSTEM AND APPARATUS

(71) Applicant: Texas Tiny Pools, Austin, TX (US)

(72) Inventor: Amy Dunnem Hageman, Austin, TX (US)

( * ) Notice: Subject to any disclaimer, the term of this patent is extended or adjusted under 35 U.S.C. 154(b) by 515 days.

(21) Appl. No.: 16/947,010

(22) Filed: Jul. 15, 2020

(65) Prior Publication Data

US 2021/0017780 A1 Jan. 21, 2021

Related U.S. Application Data

(60) Provisional application No. 62/874,168, filed on Jul. 15, 2019.

(51) Int. Cl.

| | |
|---|---|
| ***E04H 4/08*** | (2006.01) |
| ***G08B 21/18*** | (2006.01) |
| ***E04B 1/00*** | (2006.01) |
| *G08B 3/10* | (2006.01) |

(52) U.S. Cl.

CPC ..... *E04H 4/086* (2013.01); *E04B 1/003* (2013.01); *G08B 21/182* (2013.01); *G08B 3/10* (2013.01)

(58) Field of Classification Search

CPC ..... E04H 4/086; E04H 4/08; E04H 4/082; E04H 4/084; E04H 4/088

See application file for complete search history.

(56) References Cited

U.S. PATENT DOCUMENTS

| | | | | |
|---|---|---|---|---|
| 3,209,373 | A * | 10/1965 | Meredith | E04H 4/084 52/73 |
| 4,165,543 | A * | 8/1979 | Reinert | E04H 4/084 4/500 |
| 2007/0220666 | A1* | 9/2007 | Diarte | E04H 4/086 4/498 |
| 2008/0016611 | A1* | 1/2008 | Khalaf | E04H 4/086 4/498 |
| 2009/0217599 | A1* | 9/2009 | Jackson | E04H 4/086 52/64 |
| 2011/0225902 | A1* | 9/2011 | Pouthe | B61D 39/002 52/64 |
| 2012/0315828 | A1* | 12/2012 | Kuhlman | B24C 3/06 451/38 |
| 2017/0215261 | A1* | 7/2017 | Potucek | F04D 15/0066 |
| 2020/0270886 | A1* | 8/2020 | Guilfoyle | A61H 33/6005 |
| 2020/0311227 | A1* | 10/2020 | Bennett | H04L 63/0428 |

FOREIGN PATENT DOCUMENTS

| | | | | |
|---|---|---|---|---|
| FR | 2979654 | * | 3/2013 | E04H 4/086 |

* cited by examiner

*Primary Examiner* — J C Jacyna
(74) *Attorney, Agent, or Firm* — Lee & Hayes, P.C.

(57) ABSTRACT

Embodiments, apparatuses, and systems for improving the safety and reducing operating costs associated with owning and/or operating a pool. For example, the system may be configured as an above-surface grade deck or traversable and retractable cover for a pool basin or other yard obstruction. In some cases, the deck may include open positions to expose the pool basin and closed position to cover the pool basin.

20 Claims, 21 Drawing Sheets

CONVERTIBLE POOL COVER SYSTEM AND APPARATUS

CROSS-REFERENCE TO RELATED APPLICATION(S)

This application claims priority to U.S. Provisional Application No. 62/874,168, filed on Jul. 15, 2019 and entitled "Pool With Convertible Cover," the entirety of which is incorporated herein by reference.

BACKGROUND

Pools continue to pose a significant risk to the health of individuals, particularly young children. In some cases, various government have imposed safety regulations, such as door and window alarms, fences, and gates, to improve the overall safety of pools. While these safety measures may reduce the access to the pool vicinity, they often fail to improve safety when the young child has access to the pool, such as a homeowner's child whom may easily access the backyard. Additionally, pools can cause a significant cost to the homeowner. One source of the costs may result from replacing or refilling water that has evaporated. These costs can be significant in warm dry climates.

BRIEF DESCRIPTION OF THE DRAWINGS

The detailed description is described with reference to the accompanying figures. In the figures, the left-most digit(s) of a reference number identifies the figure in which the reference number first appears. The use of the same reference numbers in different figures indicates similar or identical components or features.

DETAILED DESCRIPTION

Figure 1:
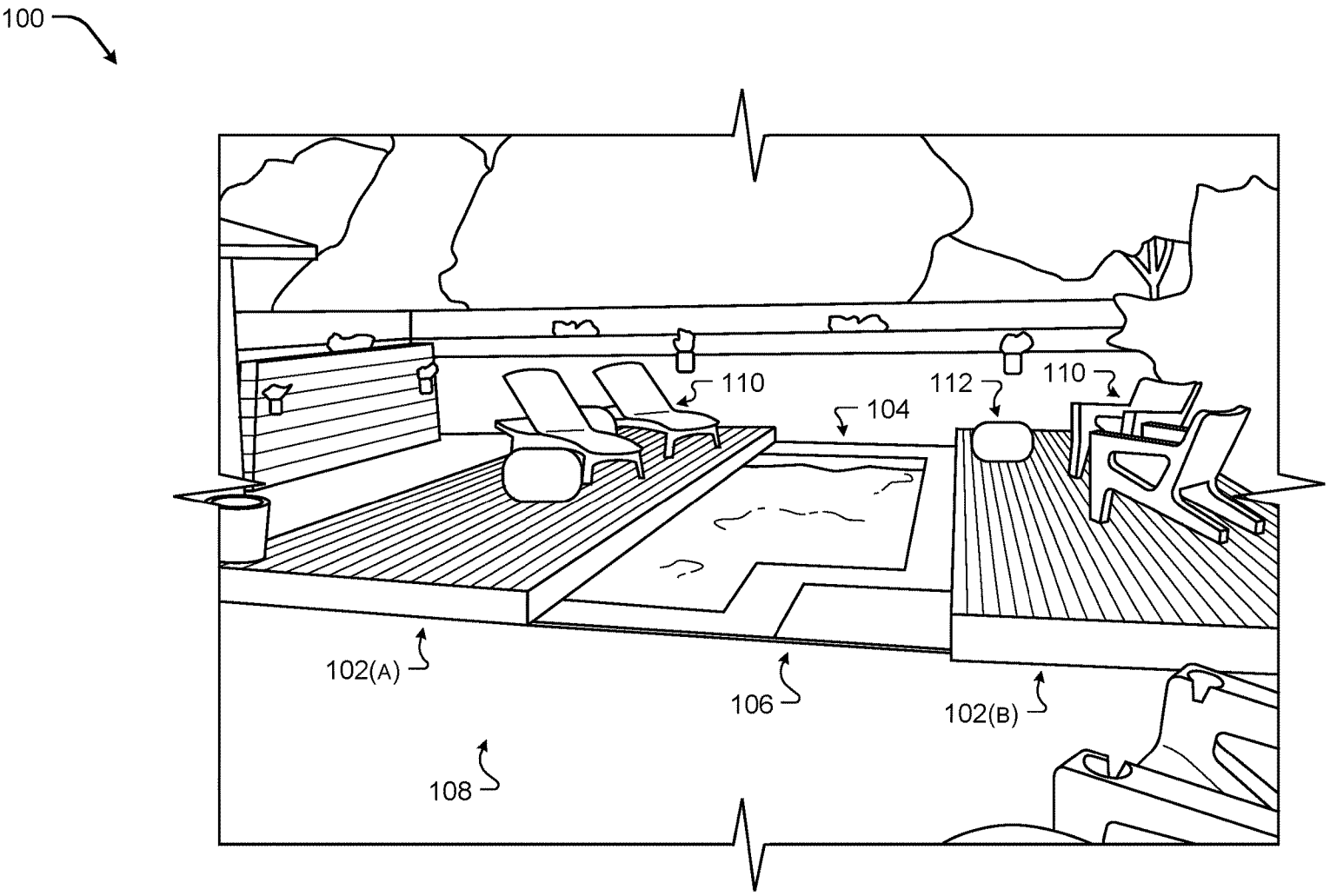
FIG. 1 is a pictorial view of an example deck cover of a pool basin in accordance with embodiments of the disclosure.

Discussed herein are embodiments, apparatuses, and systems for improving the safety and reducing operating costs associated with owning and/or operating a pool. The apparatuses and systems, discussed herein, may also increase the overall usable surface space within a yard containing a pool or pool basin. For example, in some implementations, the system may be configured as an above-surface grade deck or traversable cover for a pool or other yard obstruction. In some cases, the cover may be retractable such that when the cover is not in use, individuals may access the pool located beneath the cover or deck.

In some implementations, the cover or deck may be formed of various types of plastic, aluminum, or other water impermeable or resistant material (such as wood or lumber injected with vinegar) and may be physical coupled to or adjacent (e.g., within 18 inches of the coping of the pool basin) to the coping and/or the pool body. In some cases, the coupling may be in the form of one or more casters coupled to the decking and contained or housed within a track or rail system. The rail system may be coupled to or physically proximate to the coping and/or the pool body, such that the deck or cover may slide or otherwise traverse along the rail to cover and uncover the surface of the pool.

In some cases, when the deck or cover is in the closed position, the cover may act to prevent evaporative loss of water within the pool. Often, one of the major expenses and/or maintenance tasks of operating a pool may include filling or refilling the pool to replace water lost to evaporation, particularly in warm weather climates or states, and adding chemicals to insure the water is both safe and healthy for individual swimmers. For example, in some implementations, the cover or deck, discussed herein, may prevent up to approximately 92% of normal water loss when compared with an uncovered pool surface. In some cases, the deck or cover may include tightly fitting planks of a plastic or water impermeable material. For instance, the planks of the panel may be spaced apart by less than or equal to 1/16, 1/8 of an inch, or 1/4 an inch in various different implementations. In some examples, the planks may be sealed or caulked (e.g., via resin, silicon, adhesive, or other curable material) to further prevent water vapor from escaping the pool basin when the cover is in the closed position.

In some cases, in addition to reducing water loss through evaporation and, thereby, reducing chemical consumption associated with pool ownership, the cover may prevent rain, sediment, plant matter, and other windborne debris from collecting in the pool basin. Thus, the deck or cover, discussed herein, may maintain cleaner water within the pool basin than uncovered pools or pools using conventional covers. The cleaner water (e.g., the reduction in debris within the pool basin) reduces the run time and intensity associated with the pool pump and/or other cleaning and maintenance systems associated with the pool basin, thereby extending the usable lifetime of the pool equipment and further reducing operating costs of pool ownership.

In some implementations, the retractable above surface-grade cover or decking may also act to maintain a desired temperature within the pool water. For instance, in cooler weather climates or states, the pool cover may help the pool water to retain heat through, for instance, the cooler temperatures experienced during the night. Again, by maintaining a more stable temperature of the pool water, the active time (run time), the costs, and the wear and tear of the heater, the chiller, and other environmental control systems associated with the pool may be reduced. Again, the deck cover, discussed herein, reduces the operating costs and extends the operating life of the pool systems and controls.

In various implementations, the cover or deck may also act as a safety device or measure in addition to other conventional safety measures associated with a pool, such as alarms, gates, and locks. Conventionally, many jurisdictions require pools to be fenced, with locks and alarms, to prevent pets, children, sick, or elderly from accidently falling into the pool and drowning. While the conventional safety systems act to prevent individuals and animals from entering the yard containing the pool basin, the conventional safety systems do little to prevent a pet or individual (such as a child) already within the yard from falling into the pool basin. However, the above surface-grade deck cover, discussed herein, is formed from a ridged, stiff, and supported structure that allows the individual or animals to traverse the surface of the deck as if the deck was part of the surface of the yard. In this manner, the decking or cover, discussed herein, provides for additional safety features absent in the traditional and required pool safety measures, such as preventing drowning for individuals and animals that enter the yard containing the pool.

In some examples, the deck or cover may lock when in the closed position. For instance, the decking may include a foot anchor bolt for individual moveable sections of the decking that couple or latch to locking mechanisms coupled to the pool basin and/or concrete or other fixed structures adjacent to the pool basin. In some cases, the foot anchor bolts may lock via a key, passcode, or other securing means. In this manner, if an individual, such as a child, enters the yard, the child would be unable to unlock the anchor bolt and free or open the surface of the pool to the yard.

In some cases, the deck is comprised of a single or double panel, constructed of various water-resistant woods (e.g., wood planks, such as pine injected with vinegar), plastic materials, or rust resistant metals (such as Aluminum). In some cases, the materials and products are selected for their resistance to water, surface texture (e.g., slip-resistance), ability or long-term fidelity in appearance, color and integrity when exposed to the varying elements of water and chemicals over extended outdoor use. In some cases, the decay rate of the decking may be 10% or less over a 10-year period (including decay caused by insect damage, such as termites). In some examples, the tangential shrinkage rate of the decking material is less than 15% from a fully soaked to oven dry state. In other examples, the tangential shrinkage rate of the decking material is less than 12% from a fully soaked to oven dry state. In some cases, the decking may be configured to pile or stack when opened to accommodate smaller yard sizes. In some cases, the decking may also be formed from aluminum, synthetic decking material (such as plastics or polymers), and the like.

In some examples, the decking may be mounted on a substructure formed from a light-gage aluminum (e.g., Alloy 6061-T6) that is rolled or extruded members, carbon fiber, fiberglass, or other water-resistant material. The deck substructure may include a perimeter welded or riveted frame of aluminum channel shape (C10×3½×0.25 or similar). In some cases, the joists of the substructure may be spaced apart by between approximately 6 inches and 12 inches apart on center. In other examples, the joists of the substructure may be spaced apart by between approximately 12 inches and 24 inches apart on center. In one specific example, the joists of the substructure may be spaced apart by between approximately 16 inches apart on center. In some cases, the joists may be between approximately 2 inches and 4 inches wide and 4 inches and 6 inches tall. In some implementation, the joists may be formed in a substantially I-beam shape.

In some implementations, the joists may span between the perimeter frame (top of joist is held flush with top of perimeter frame) and are supported on the perimeter frame by welds or brackets with stainless steel screws. In some cases, the material of the substructure should have a tensile strength of approximately 40,000 PSI or greater and a yield strength of approximately 33,000 PSI or greater. In a specific case, the material of the substructure should have a tensile strength of approximately 42,000 PSI or greater and a yield strength of approximately 35,000 PSI or greater.

In some examples, the fasteners and brackets may be hot-dip galvanized and the connections (including welds) are cold galvanized after assembly. The deck planks span from joist to joist, with no individual plank anchored to fewer than 3 joists of the substructure. The deck panel may be designed as a rollaway element to allow for covering and uncovering the pool. In some cases, a single panel may be used, while in other examples, a double panel or other multi-panel deck may be used. For instance, in some cases, 3-6 panels may be used to cover a pool basin, particularly in the case in which the deck is covering a non-rectangular pool basin.

In some implementations, casters or wheels may be affixed to the underside of parallel sides of the aluminum perimeter frame members, such as the exterior joists of the substructure. When the panels are over the pool basin (pool is partially or fully covered), the casters ride on or are otherwise coupled to tracks mounted to the outside face of the pool walls or to a structure adjacent to the pool walls. In some examples, the tracks may be formed from A36 steel angles (L4×4×¼ or similar, where the sizing is shown length of vertical leg in inches by length of horizontal leg in inches by thickness of legs in inches), hot-dip galvanized and mounted to the exposed outside face of the pool wall or adjacent structure with post-installed mechanical expansion anchors, bolts or otherwise drilled and epoxied anchors. When the panels are outside of the pool dimensions (pool is partially or fully uncovered), the casts ride on half-pipe rails (A53 steel or similar) cast into the exposed top face of concrete grade beams. The grade beams are cast-in-place conventionally-reinforced concrete (10" wide by 20" deep or similar, with a length to match or exceed the corresponding dimension of the deck panel supported. In some cases, each half-pipe rail features a wheel stop consisting of a short piece of steel angle (L2×2×¼ or similar) mounted perpendicular to the half-pipe rail with the purpose of arresting the travel of the pool deck panel. In some cases, the wheels of the casters may be formed from water proof or resistant materials, such as aluminum, carbon, various plastics, polyurethane, or the like. The wheel is either welded directly to the half-pipe rail or fastened with post-installed anchors to the concrete grade beam below (anchors to match those use for the angle rails mounted to the pool walls).

FIG. 1 is a pictorial view 100 of an example deck cover of a pool basin 104 in accordance with embodiments of the disclosure. In the current example, the deck may include a first panel 102(*a*) and a second panel 102(*b*) that may slide or move along tracks or rails 106 with respect to the pool basin 104, such that each panel 102 may have an open and a close position. In the current example, the pool basin 104 may completely cover the pool basin such that the water within the pool is inaccessible to an individual or animal in the yard 108. In this example, the panels 102(*a*) and 102(*b*) may be movable independently of each other, such that as shown, one panel 102(*b*) may be open and panel 102(*a*) may be closed to partially expose the water of the pool basin 104. In the current example, the panels 102 may slide widthwise with respect to the pool basin 104, however, it should be understood that in other examples, the panels 102 may slide in various other directions, such as lengthwise with respect to the pool basin 104.

In the illustrated example, furniture, such as the chairs 110 and the ottomans 112, are present and supported by the panels 102. In various implementations, the individual panels 102 may be configured to support greater than 2000 pounds. In other implementations, the individual panels 102 may be configured to support greater than 3000 pounds. In yet another implementation, the individual panels 102 may be configured to support greater than 4000 pounds. In still other implementation, the individual panels 102 may be configured to support greater than 10000 pounds. In still other implementation, the individual panels 102 may be configured to support greater than 15000 pounds. In still other implementation, the individual panels 102 may be configured to support greater than 19000 pounds. In various examples, the panels 102 may be configured to support at least 8 pounds per square foot dead load, at least 10 pounds per square foot dead load, at least 15 pounds per square foot dead load, at least 20 pounds per square foot dead load, and the like. In some examples, the panels 102 may be configured to support at least 60 pounds per square foot. In another example, the panels 102 may be configured to support at least 30 pounds per square foot. In another example, the panels 102 may be configured to support at least 40 pounds per square foot. In another example, the panels 102 may be configured to support at least 50 pounds per square foot.

Figure 2:
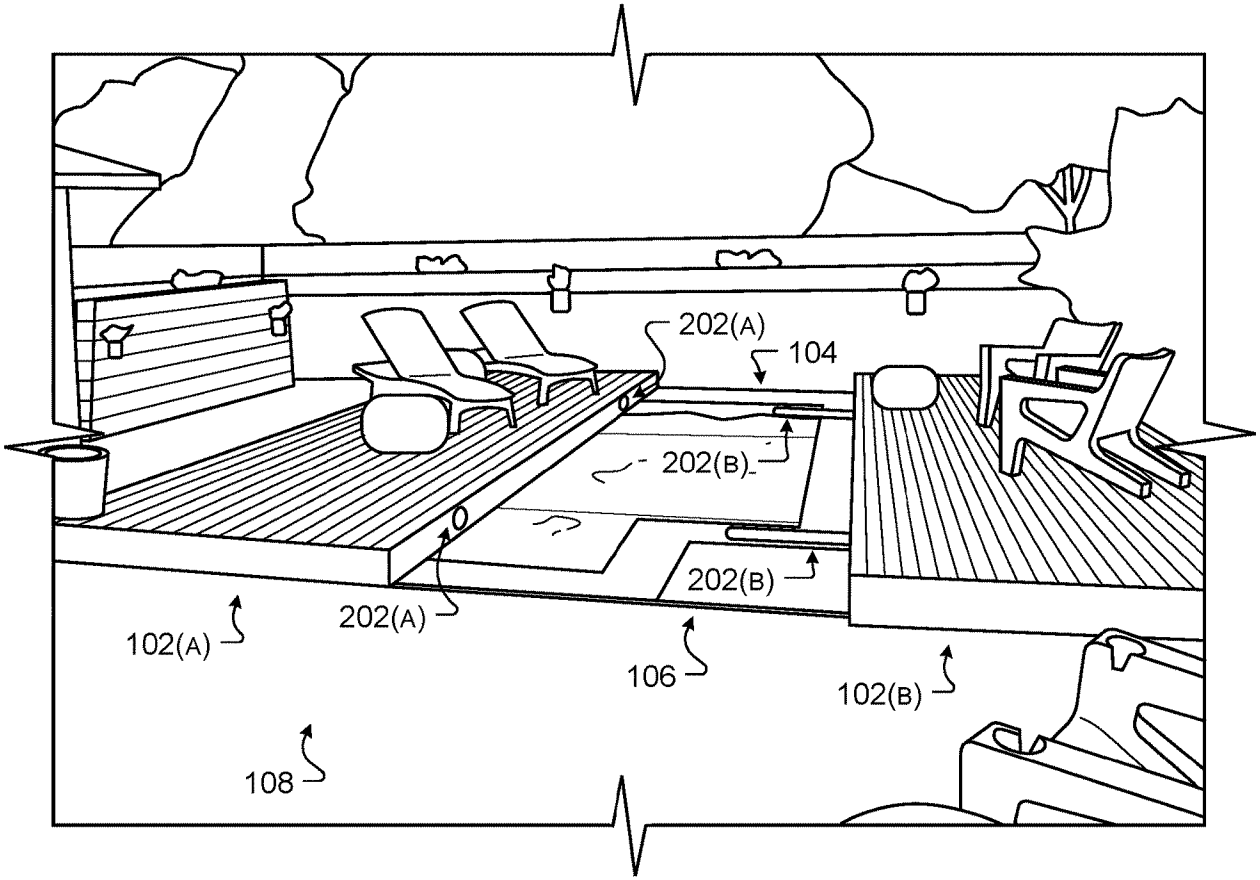
FIG. 2 is another pictorial view of an example deck cover of FIG. 1 in accordance with embodiments of the disclosure.

FIG. 2 is another pictorial view 200 of an example deck cover of FIG. 1 in accordance with embodiments of the disclosure. In the current example, the first panel 102 and the second panel 102(*b*) may include mating members, generally indicated by 202(*a*) and 202(*b*), to allow the panels 102 to lock or mate together when both panels 102 are in a closed position. In the current example, the mating members 202(*a*) are shown as female mating members and the members 202(*b*) are shown as male mating members, but it should be understood that either panel 102(*a*) or 102(*b*) may include any number of male or female mating members 202. For instance, each panel 102 may include a male and a female mating member 202 that mates with a corresponding male or female member on the opposing panel 102. In some case, the male mating members 202(*b*) may be configured to retract as the panel 102(*b*) is moved into an open position along the rails 106, such that the male members 202(*b*) may be substantially flush with the side surface of the panel 102(*b*). Similarly, the female mating members 202(*a*) may be configured to close or shut as the panel 102(*a*) is moved into the open position to again increase the overall safety of the decking 102. In some cases, the mating members 202 may be configured to key or lock together when both panels 102 are in the closed position. For example, the male members 202(*b*) may include a groove along the surface that may, for example, be rotated (e.g., the male member 202(*b*) rotates as the panel 102(*b*) is closed) into position with a clasp mechanism of the female mating member 202(*a*) when both panels 102 are in the closed position.

Figure 3:
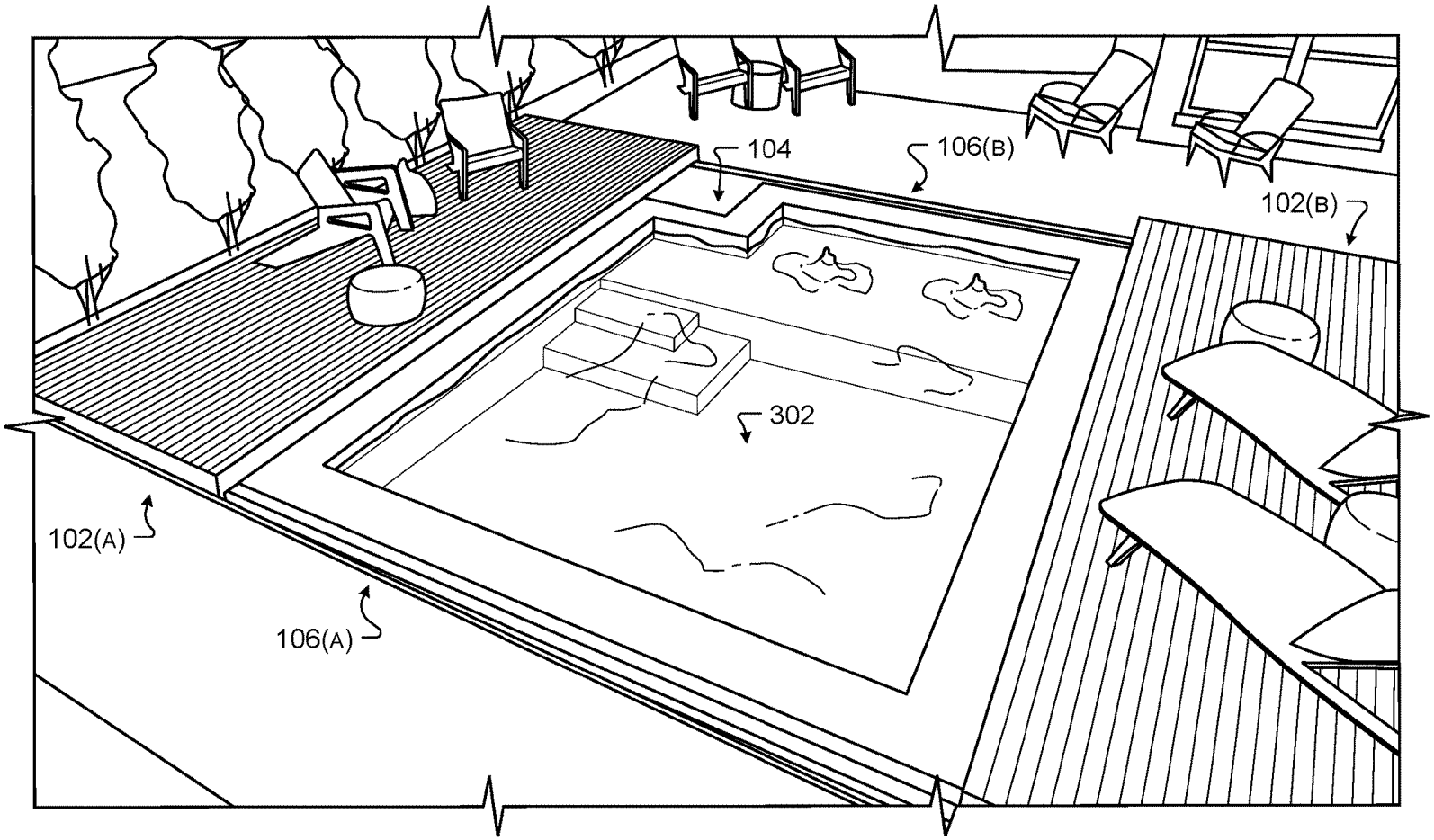
FIG. 3 is another pictorial view of an example deck cover of FIG. 1 in accordance with embodiments of the disclosure.

FIG. 3 is another pictorial view 300 of an example deck cover of FIG. 1 in accordance with embodiments of the disclosure. In the current example, both panels 102(*a*) and 102(*b*) of the deck are shown in an open position exposing the water 302 of the pool basin 104. In the current example, the first panel 102(*a*) and the second panel 102(*b*) may be physical and mechanically coupled such that if an individual moves either the first panel 102(*a*) or the second panel 102(*b*), the other panel 102(*a*) or 102(*b*) may also move in a similar manner. For instance, if an individual retracts (e.g., moves from a closed to an open position) the first panel 102(*a*), the second panel 102(*b*) may also retract. Similarly, if the individual closes (e.g., moves from an open position to a closed position) the first panel 102(*a*), the second panel 102(*b*) may also close.

In the illustrated example, tracks or rails 106 are visible on both sides of the pool basin 104. Thus, in the current example, the tracks or rails 106(*a*) and 106(*b*) may be positioned adjacent to the pool basin 104. It should be understood that in other examples, the tracks or rails 106 may be secured or fastened to the pool basin 104 itself. In some cases, the tracks or rails 106 may be formed from aluminum or other water-resistant materials. In some implementations, such as the illustrated example, the tracks 106 may form a triangular shape such that the wheels of the casters coupled to the panels 102 may rest upon the tracks 106 with at least a portion of the track 106 between a first and second side of the wheels. In another example, the tracks 106 may include a grooved portion into which the wheels of the casters of the panels 102 may be received.

In some cases, the panels 102 may be between 5.0 feet and 25 feet wide, between 5.0 feet and 25 feet long, and between half a foot and 2 feet tall. In other cases, the panels 102 may be between 10 feet and 20 feet wide, between 10 feet and 20 feet long, and between half a foot and 1.0 foot tall. In still other cases, the panels 102 may be between 5 feet and 15 feet wide, between 5 feet and 15 feet long, and between half a foot and 1.0 foot tall.

Figure 4:
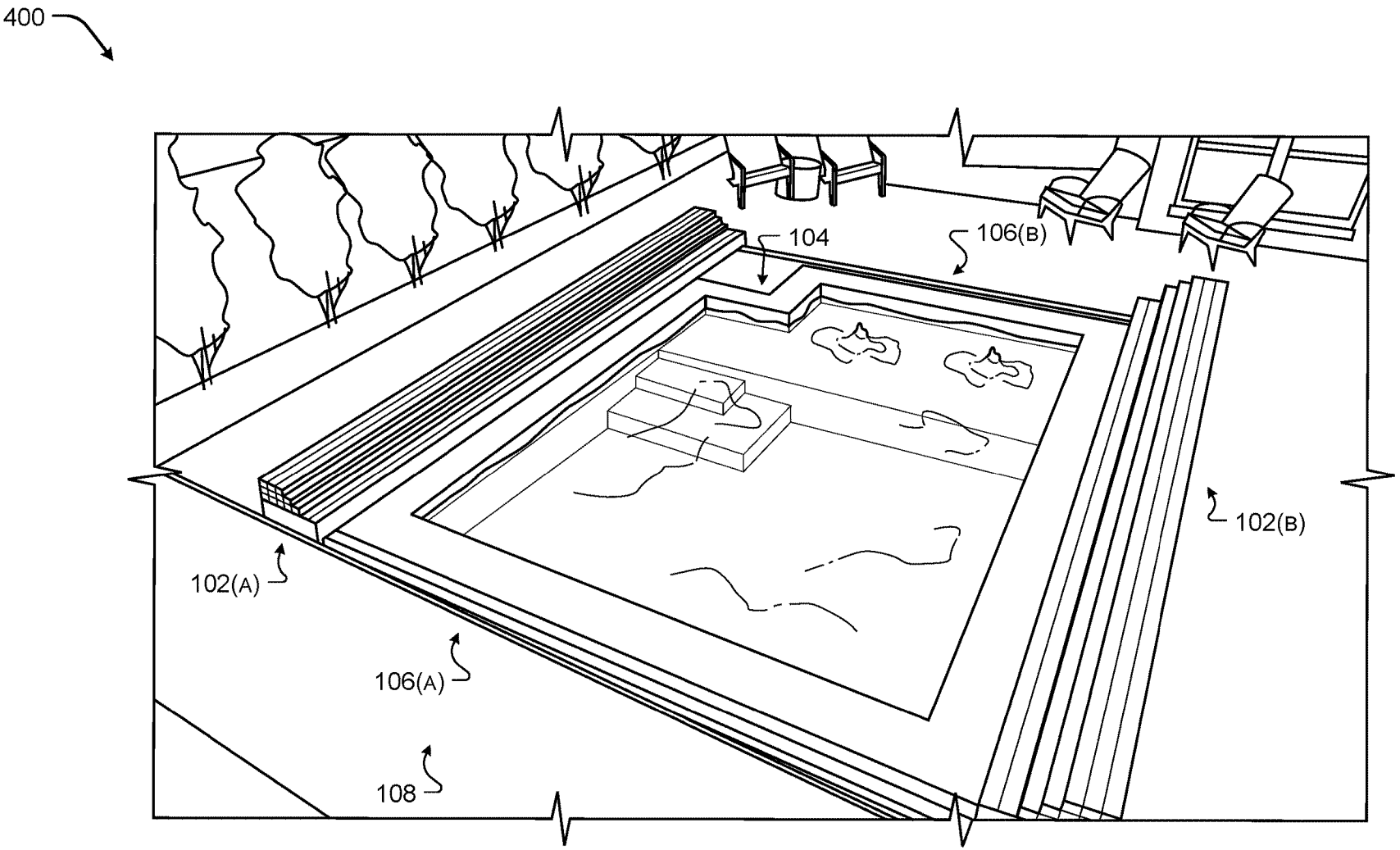
FIG. 4 is another pictorial view of an example deck cover of FIG. 1 in accordance with embodiments of the disclosure.

FIG. 4 is another pictorial view 400 of an example deck cover of FIG. 1 in accordance with embodiments of the disclosure. In the illustrated example, planks or sections of each of the panels 102 may be configured to stack or otherwise collect along opposing sides of the pool basin 104. For instance, in some situations, the yard 108 containing the pool basin 104 may be too small or otherwise shaped to prevent the panels 102 from sliding to one or more sides of the pool basin 104. This can be a particular concern in cities or urban environments in which land is expensive and lots are typically very small. In this example, the sections of each panel 102 may be mechanically coupled such that as the are opened preceding sections are elevated over a current section, such that each section stacks or rests upon a lower section. In another example, the sections may be configured to tilt vertically such that each section of the panels 102 rotate by 90 degrees when in the stacked or open position (such that the sections of the panels 102 are vertical when stacked).

In some cases, such as the illustrated example, the panels may be motorized such that a motor (not shown) may be mechanically coupled via one or more gears to the panels 102 to apply a torque or other force that causes the panels 102 to traverse along the tracks or rails 106 to thereby open or close the pool basin 104. In one example, each individual panel 102 may include a separate motor, while in other examples, one motor may be configured to operate one or more of the panels 102. In some instances, a user may operate the motor or the panels 102 via an electronic device, such as a mobile phone, tablet, remote control, or other computer system, that is in wireless communication with the motor or a system controller or circuit.

In some examples, the stackable sections of the panels 102 may be formed from one or more planks. In other cases, the sections may include between 2 and 15 planks, between 2 and 3 planks, between 3 and 5 planks, between 5 and 10 planks and the like.

In the current example, the panels 102 are shown as stacking sections. However, in another implementation, the panels 102(*a*) and 102(*b*) may be coupled to a lift system (such as a hydraulic lift or arm) that may cause the entire panels 102 (or larger sections of the panels 102) to rotate by 90 degrees, thereby forming a privacy barrier extending upward on various sides of the pool basin 104. Thus in this example, the panels 102 may both form a usable, safe, and walkable surface when the panels 102 are in the closed position as well as a privacy screen when the panels 102 are in the open position.

Figure 5:
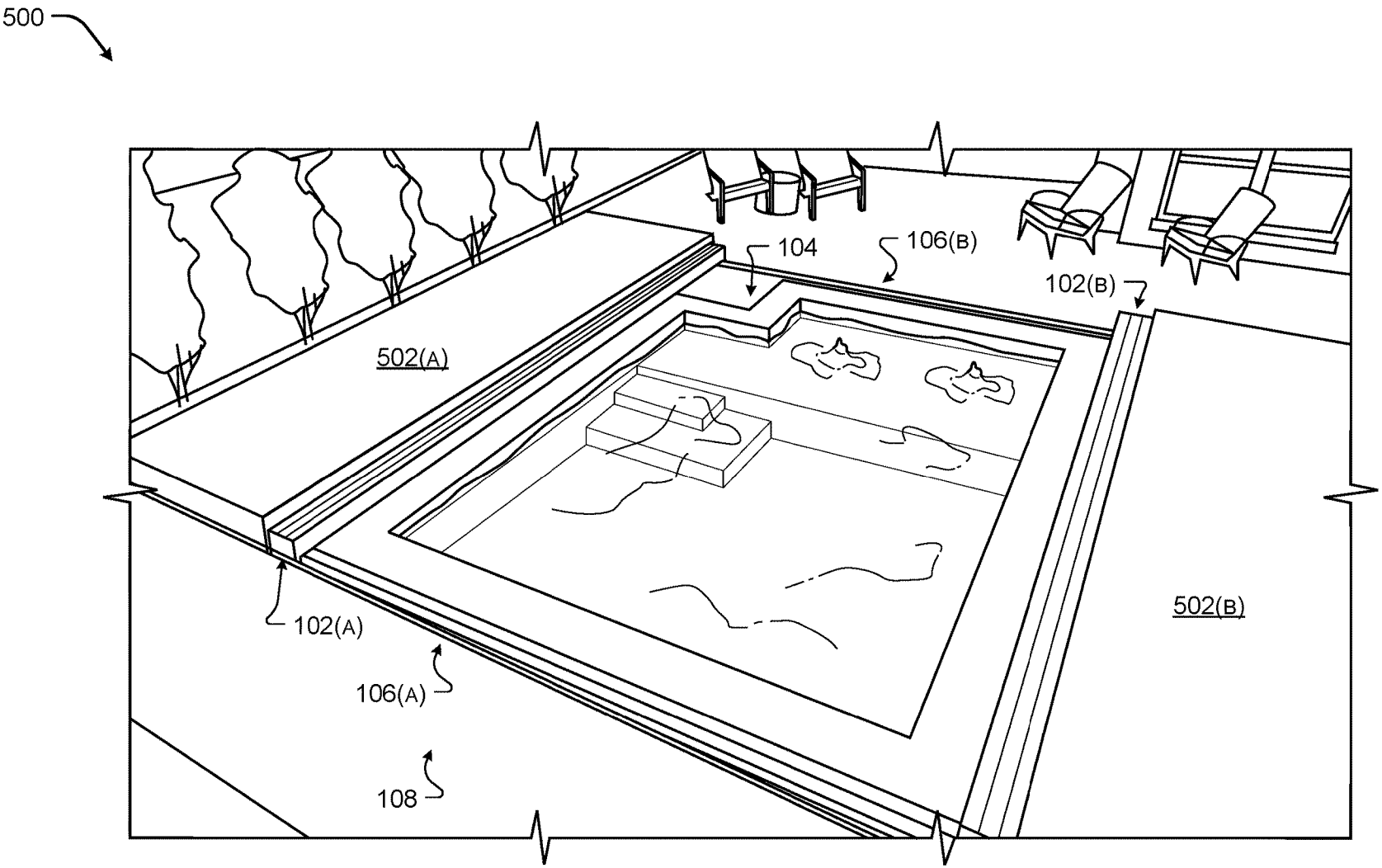
FIG. 5 is another pictorial view of an example deck cover of FIG. 1 in accordance with embodiments of the disclosure.

FIG. 5 is another pictorial view 500 of an example deck cover of FIG. 1 in accordance with embodiments of the disclosure. In the current example, the panels 102(*a*) and 102(*b*) are configured to retract (e.g., open) into corresponding covered structure 502(*a*) and 502(*b*) respectively. In this example, the covered structures 502(*a*) and 502(*b*) are shown over the surface of the yard 108. However, in other examples, the pool basin 104, the tracks 106, and/or the panels 102 may be positioned below the surface of the yard 108, such that the panels 102 may disappear when the panels 102 are in an open position. In some cases, the covered structures 502(*a*) and 502(*b*) may include a frame constructed of aluminum, plastic, or other suitable material. The frame may include one or more joists in a similar manner as the panels 102. The covered structures 502(*a*) and 502(*b*) may also include one or more support pillars below the surface of the yard 108. The support pillars may be formed of steel, concreate, aluminum or other suitable materials to support the joists of the structure 502(*a*) and 502(*b*). The joists may also be covered by one or more section of yard supporting members. The yard supporting members be formed of steel, concreate, aluminum or other suitable materials. In some examples, the yard supporting members may be covered by half an inch or more of soil or turf.

Figure 6:
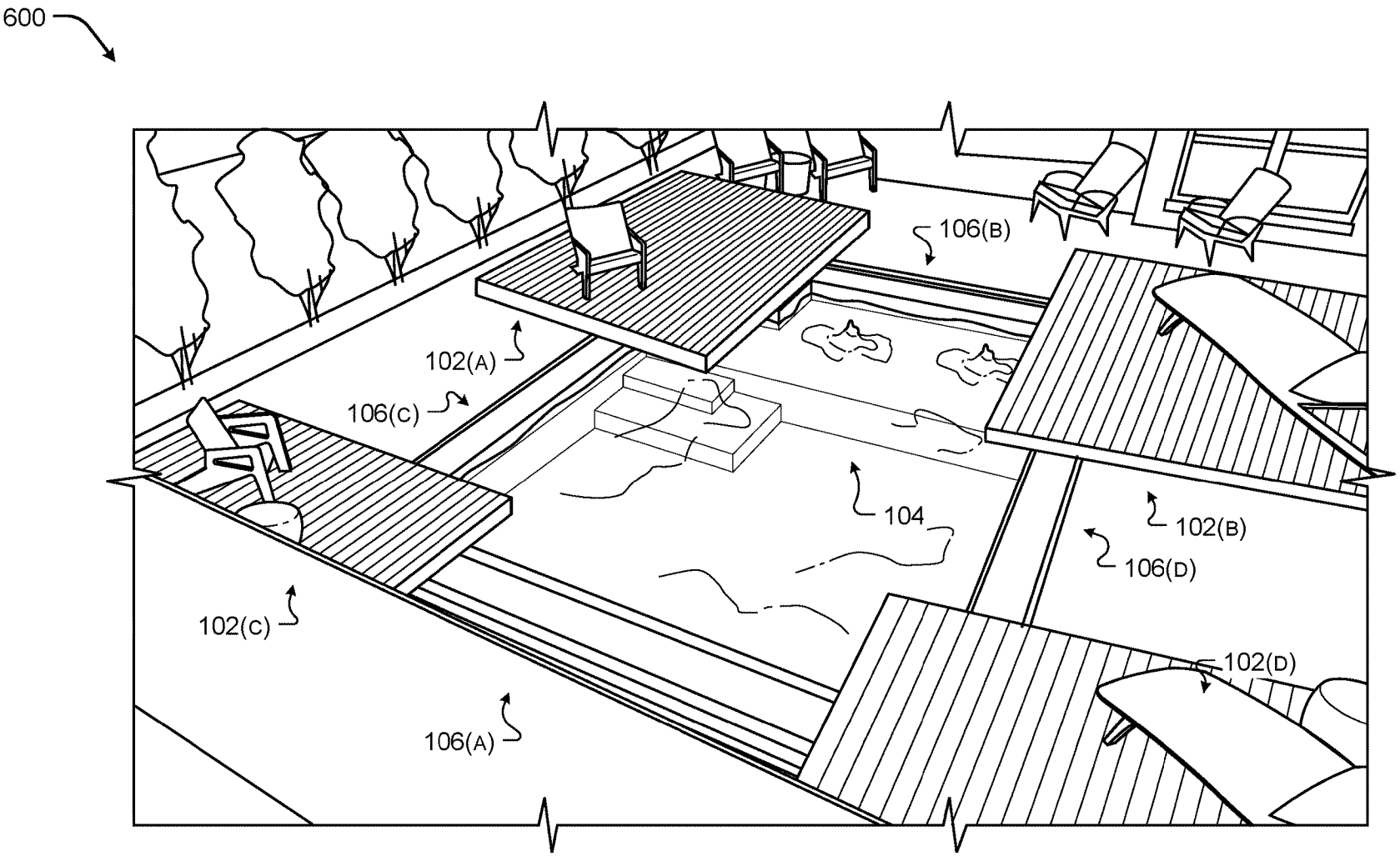
FIG. 6 is another pictorial view of an example deck cover of FIG. 1 in accordance with embodiments of the disclosure.

FIG. 6 is another pictorial view 600 of an example deck cover of FIG. 1 in accordance with embodiments of the disclosure. In the illustrated example, the deck includes the panels 102(*a*) and 102(*b*) but also includes additional panels 102(*c*) and 102(*d*). In this example, each panel 102 may be coupled to a track or rail 106 along two sides of the pool basin 104, such that each panel 102 may slide out toward a corresponding corner of the pool basin 104 as shown. In some cases, each panel 102 may be coupled to an associated rail or track 106 that is specific for the corresponding panel 102. For instance, a specific track or rail 106 may be positioned to extend outward from each corner of the pool basin 104 such that each panel 102 is coupled to the rail or track 106 at a position running diagonally across the panel 102, in the current example.

Figure 7:
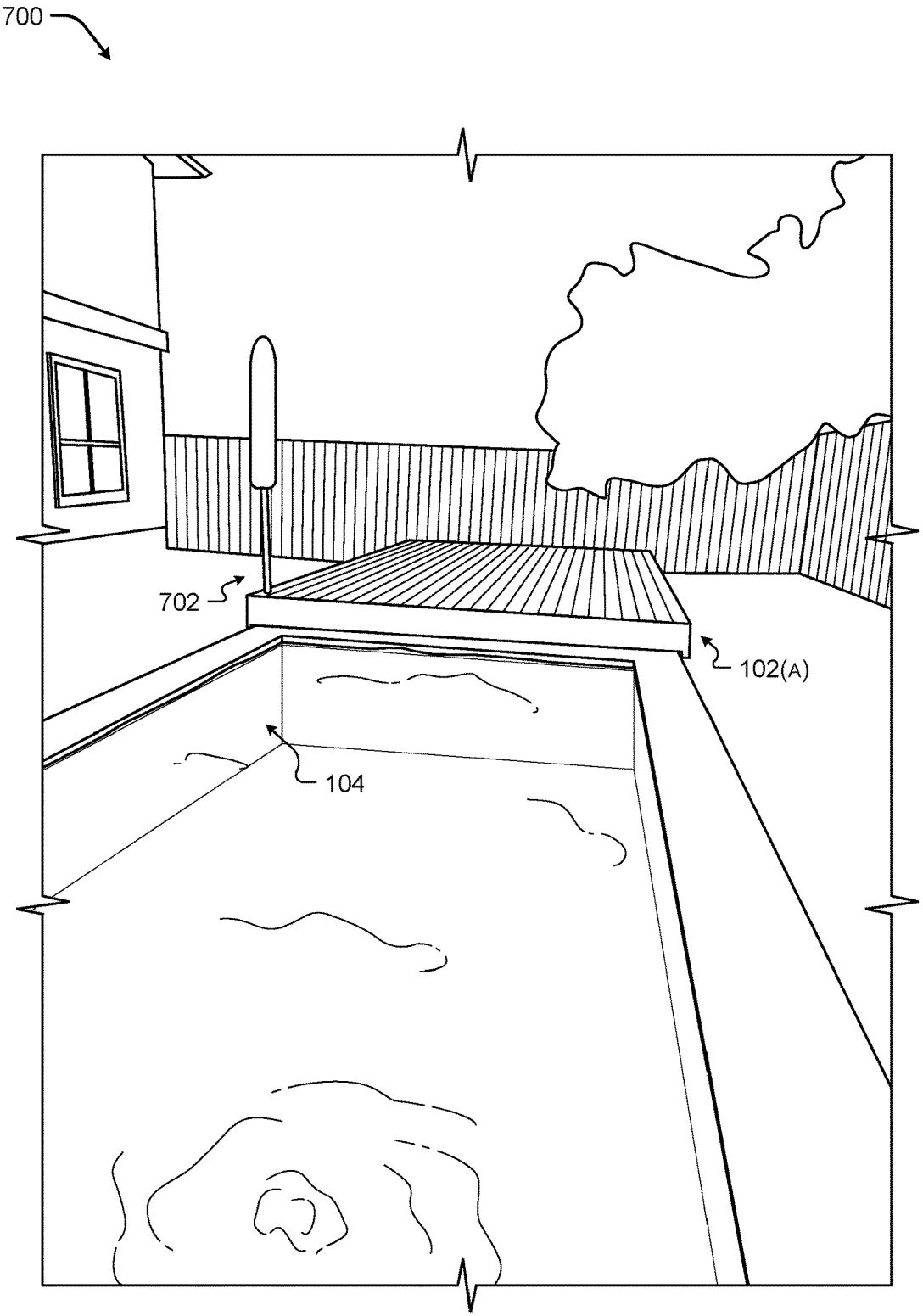
FIG. 7 is another pictorial view of an example deck cover of FIG. 1 in accordance with embodiments of the disclosure.
Figure 8:
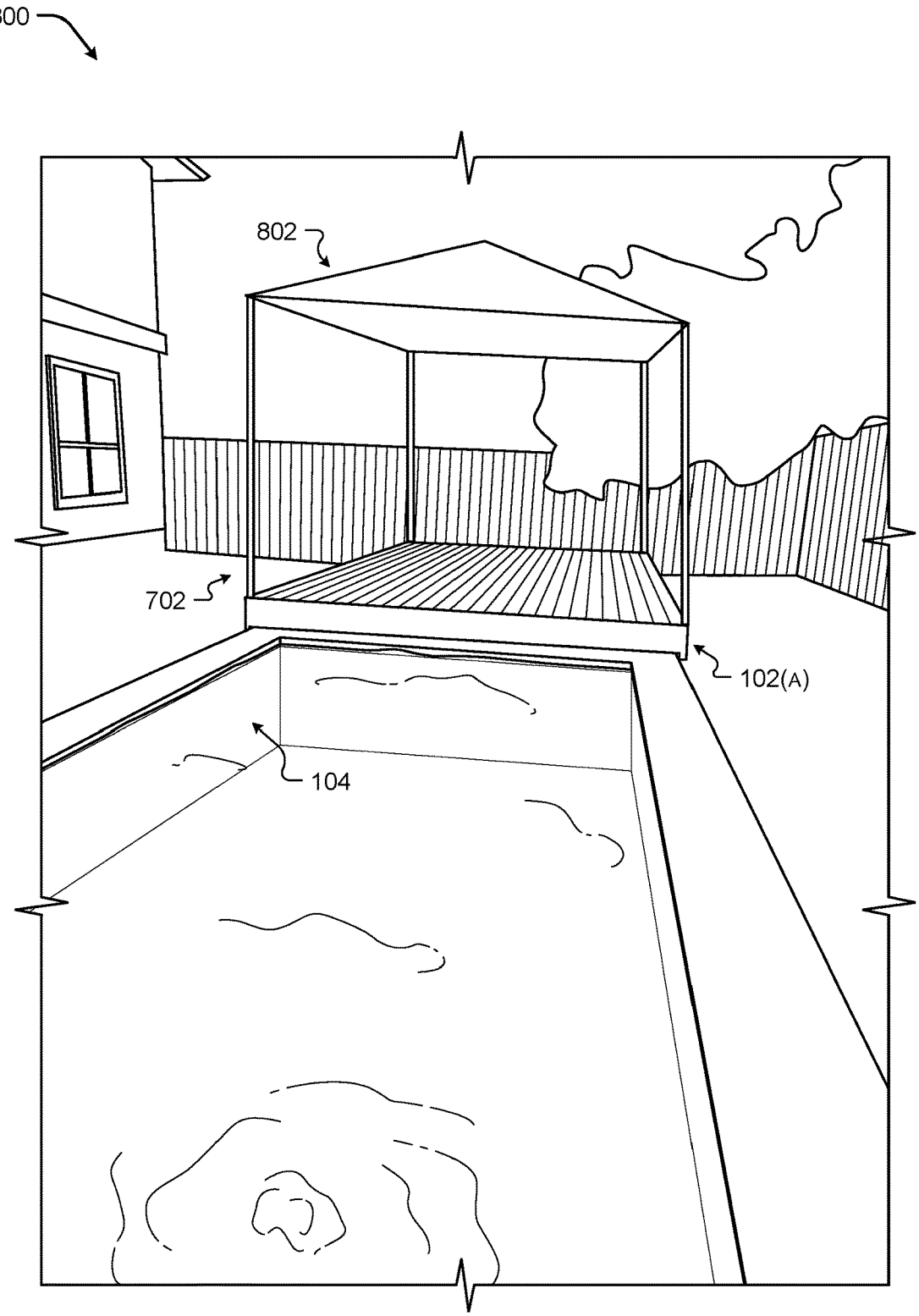
FIG. 8 is another pictorial view of an example deck cover of FIG. 1 in accordance with embodiments of the disclosure.

FIGS. 7 and 8 are pictorial views 700 and 800 of an example deck cover of FIG. 1 in accordance with embodiments of the disclosure. In the illustrated example, the deck includes a single panel 102. In this example, the panel 102 may span the entire length of the pool basin 104. Thus, in this example, the panel 102 may be coupled to tracks or rails (not shown) along two sides of the pool basin 104, as will be discussed in more detail below with respect to FIGS. 10-13. In this example, the panel 102 may also include a mechanism 702 to assist a user with opening and closing the panel 102.

In some cases, the mechanism 702 may also act to anchor the panel 102 in the fully open and fully closed positions. For example, the mechanism 702 may twist, raise, and/or lower to engage/lock with a receiving or locking mechanism physically or permanently coupled to the pool basin 104. For instance, a user may pull up while twisting on the mechanism 702 to release the panel 102 and then pull the panel 102 over the pool basin 104 by applying a force to the mechanism 702. In some cases, the mechanism 702 may be an umbrella, as shown, or other useful item, such as a chair, table, divider post, planter, and the like. For instance, the mechanism 702 may be associated with a cover or structure, as discussed below with respect to FIG. 9.

In the illustrated example, the panel 102 includes a structure 902 in which one of the support posts may also act as the mechanism 702 for locking and unlocking the panel 102. In the current example, the structure 902 is open air but it should be understood, that the structure 902 may also be partially closed (e.g., close on one or more sides), fully closed (e.g., closed on all sides), or a combination thereof, such as partially closed along each side (e.g., closed along a bottom portion of one side but open along a top portion of the one side). In some cases, the panel 102 may also include sensors, such as internal measurement units (IMU), pressure sensors, weight sensors, accelerometers, gyroscopes, image devices, motion sensors, and the like. In these cases, the sensors may be utilized to determine that the panel 102 is operating within various thresholds. For instance, the sensors maybe configured to determine if a weight limit or threshold associated with the panel is exceed and to cause a system to output a warning when the threshold is exceeded. For instance, the system may output an audible warning, send a notification to a mobile device associated with the user, and/or cause the panel 102 to transition to or lock in an open position when the weight threshold is exceeded. In another example, the system may be configured to detect based on the sensor data that the water within the pool basin is empty or otherwise free from animals or individuals when the panel 102 is in a closed position, thereby preventing anyone from becoming trapped or otherwise stuck within the pool basin 104 when the panel 102 is in the closed position. For instance, the system may analyze image data, motion data, and the like associated with the water within the pool basin 104 for a threshold period of time after the panel 102 enters the closed position to detect the presence of one or more objects within the water. In this instance, the system may output an audible warning, send a notification to a mobile device associated with one or more users of the pool, and/or cause the panel 102 to transition to or lock in an open position as additional safety measures.

Figure 9:
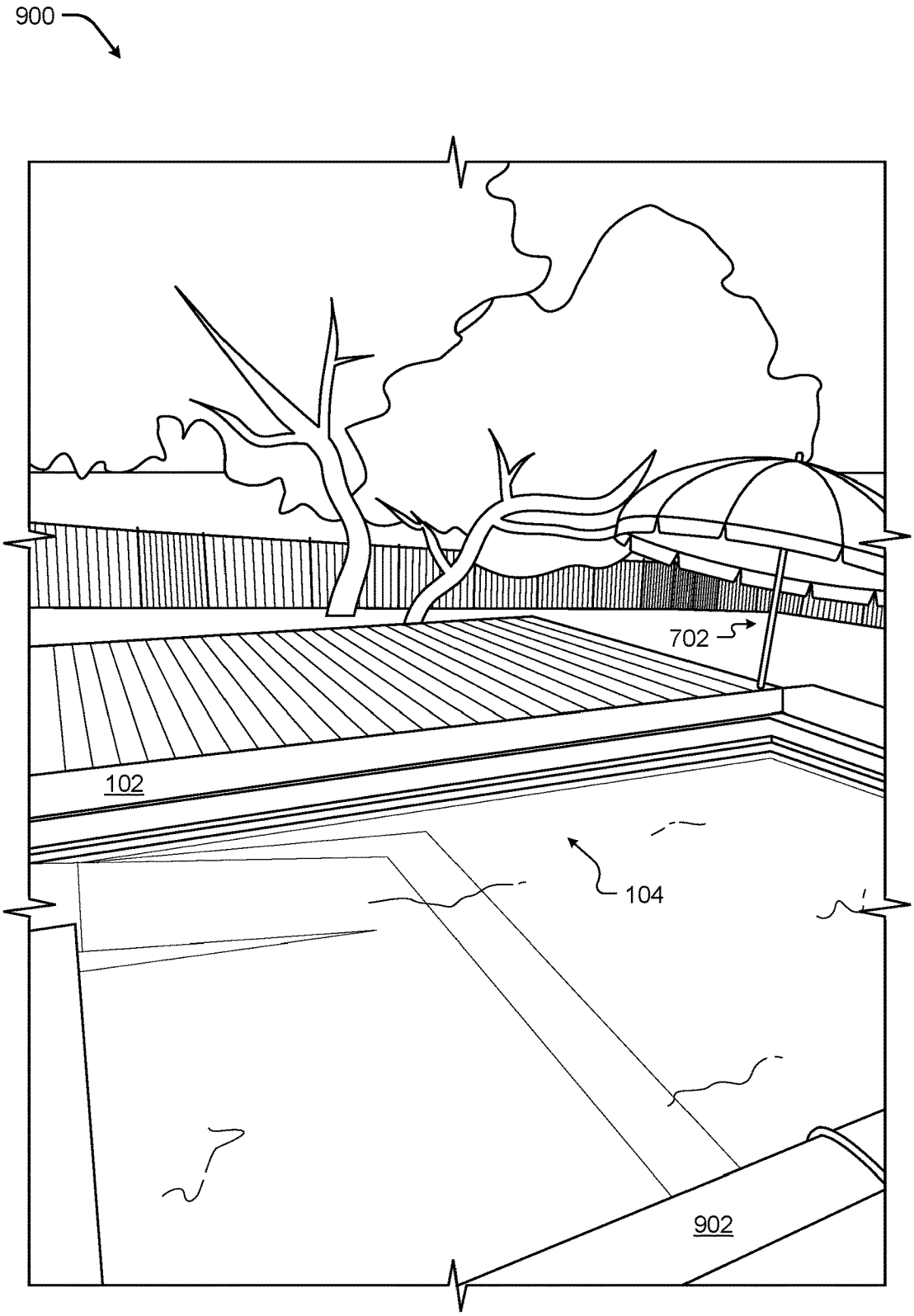
FIG. 9 is another pictorial view of an example deck cover of FIG. 1 in accordance with embodiments of the disclosure.

FIG. 9 is another pictorial view 900 of an example deck cover of FIG. 1 in accordance with embodiments of the disclosure. Similar, to FIG. 7 discussed above, the panel 102 may include a mechanism 702 configured to assist with opening and closing the panel 102 with respect to the pool basin 104. The mechanism 702 may be used to apply a horizontal force to the panel 102 to assist with moving the panel 102 along the tracks (not shown) and locking the panel 102 in the fully opened and fully closed positions.

In various examples, such as examples 1-9 above, the panels 102 may also reduce both the temperature of the water within the pool basin 104 and the amount of evaporative loss of the pool water. In some cases, the top surface of the water within the pool basin 104 may be less than approximately 1 inch from the top of the coping 902, less than approximately inches from the top of the coping 902, or less than approximately 5 inches from the top of the coping 902. Additionally, the bottom surface of the panel 102 (such as the planks of the panel 102) may be greater than approximately 3 inches from the coping 902, greater than approximately 5 inches from the coping 902, greater than approximately 8 inches from the coping 902, or greater than approximately 10 inches from the coping 902. Thus, in some cases, the distance between the surface of the water within the pool basin 104 and the bottom of the top surface of the panel 102 may be between approximately 4 inches and 15 inches. Thus, unlike conventional covers, such as vinyl or flexible covers, the cover discussed herein provides an air gap or air barrier between the water and the exterior environment, which results in cool water temperatures. The cooler water temperatures further reduced evaporative effects.

Figure 10:
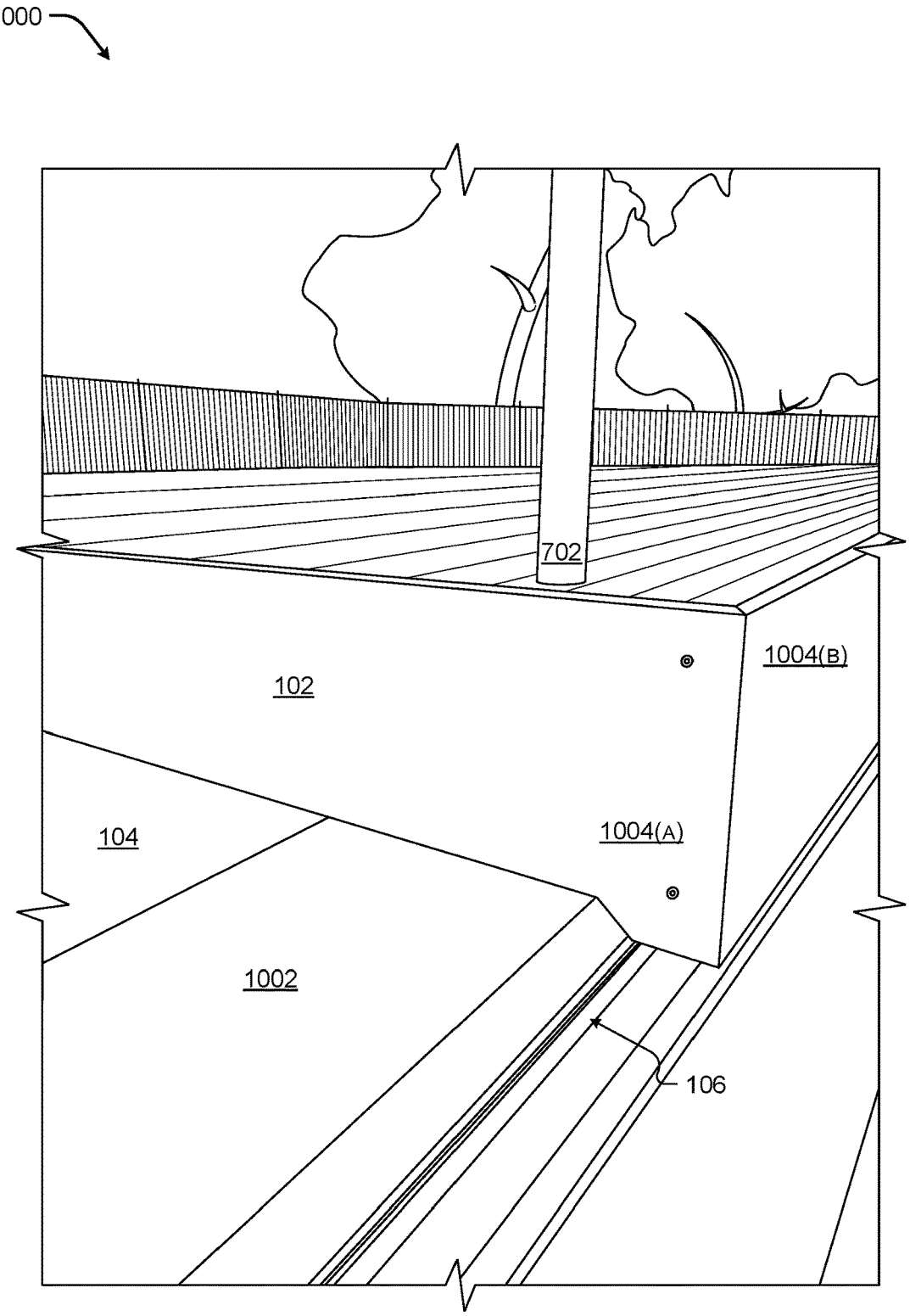
FIG. 10 is a pictorial view of the track and deck cover of FIGS. 7 and 8 in accordance with embodiments of the disclosure.

FIG. 10 is a pictorial view 1000 of the track and deck cover of FIGS. 7 and 8 in accordance with embodiments of the disclosure. In the current example, the pool basin 104 includes a coping 1002 (e.g., a tile, stone, cement, or the like area around the exterior of the pool basin 104) around the exterior of the pool basin 104. The rail or track 106 for the panel 102 is positioned adjacent to the coping 1002, as shown. In this example, the panel 102 extend over the pool basin 104, over the coping 1002, and beyond the rail or track 106. In this example, the casters or wheels associated with the panel 102 may be hidden beneath the panel 102. For instance, the panel 102 incudes side coverings, generally indicated by 1004(*a*) and 1004(*b*), that together with the top surface 1006 of the panel 102 cover a substructure as well as the wheels, castors, and locking mechanisms of the panel 102.

Figure 11:
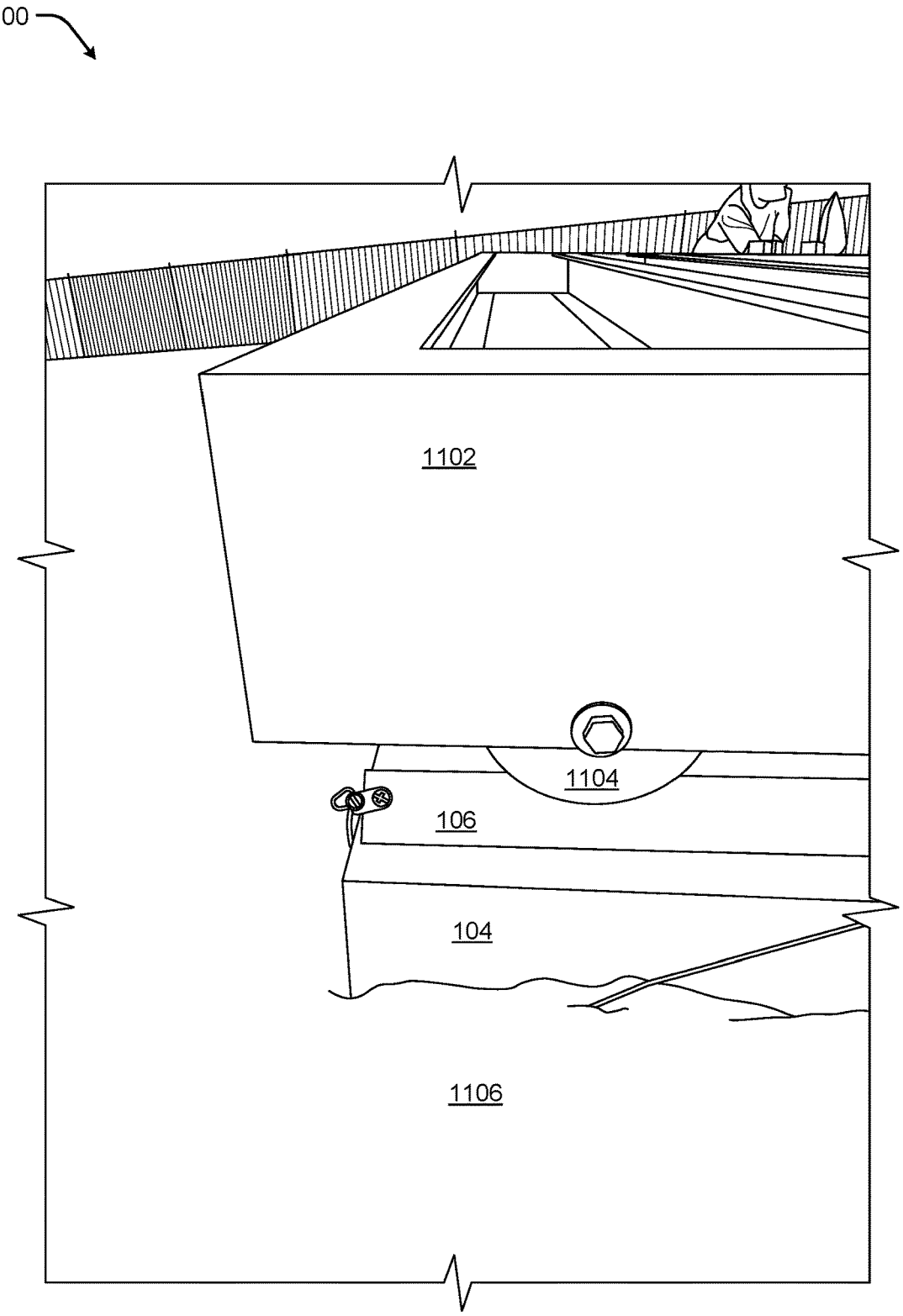
FIG. 11 is a pictorial view of a substructure of the cover of FIG. 1 in accordance with embodiments of the disclosure.

FIG. 11 is a pictorial view 1100 of a substructure 1102 of the cover of FIG. 1 in accordance with embodiments of the disclosure. In the illustrated example, the panel has not yet been installed over the substructure 1102. As shown, the wheels or casters 1104 have been integrated into the substructure 1102 and configured to rest upon or over the track 106. For instance, the track 106 is substantially triangular in shape such that the wheel 1104 may rest on either side of the peak of the triangle. In this example, the triangular shape of the track 106 assist in guiding the panel as the panel moves along the track 106 as well as to assist in ensuring the wheels 1104 remain engaged with the track 106. In this example, the track 106 is positioned along the top surface of the pool basin 104 or copping, such as coping 1002 of FIG. 10 above.

In the current example, the track 106 is directly supported by the surface of the ground 1106 via the pool basin 104 or other concrete/steel type slab. By ensuring the track 106 is not suspended the overall weight of the substructure 1102, the planks of the panel (not shown), and objects atop the surface of the panel may be more effectively supported and the likelihood of damage to the track 106 is reduced.

In some examples, the wheels 1104 and the track 106 may have a rolling coefficient of friction in the range of between 0.0001 to 0.0002. in these cases, the panel 102 may be pushed or moved with a horizontal force in the range of between 0.5 pounds to 2.5 pound or alternatively between 2.5 pounds and 5.0 pounds.

Figure 12:
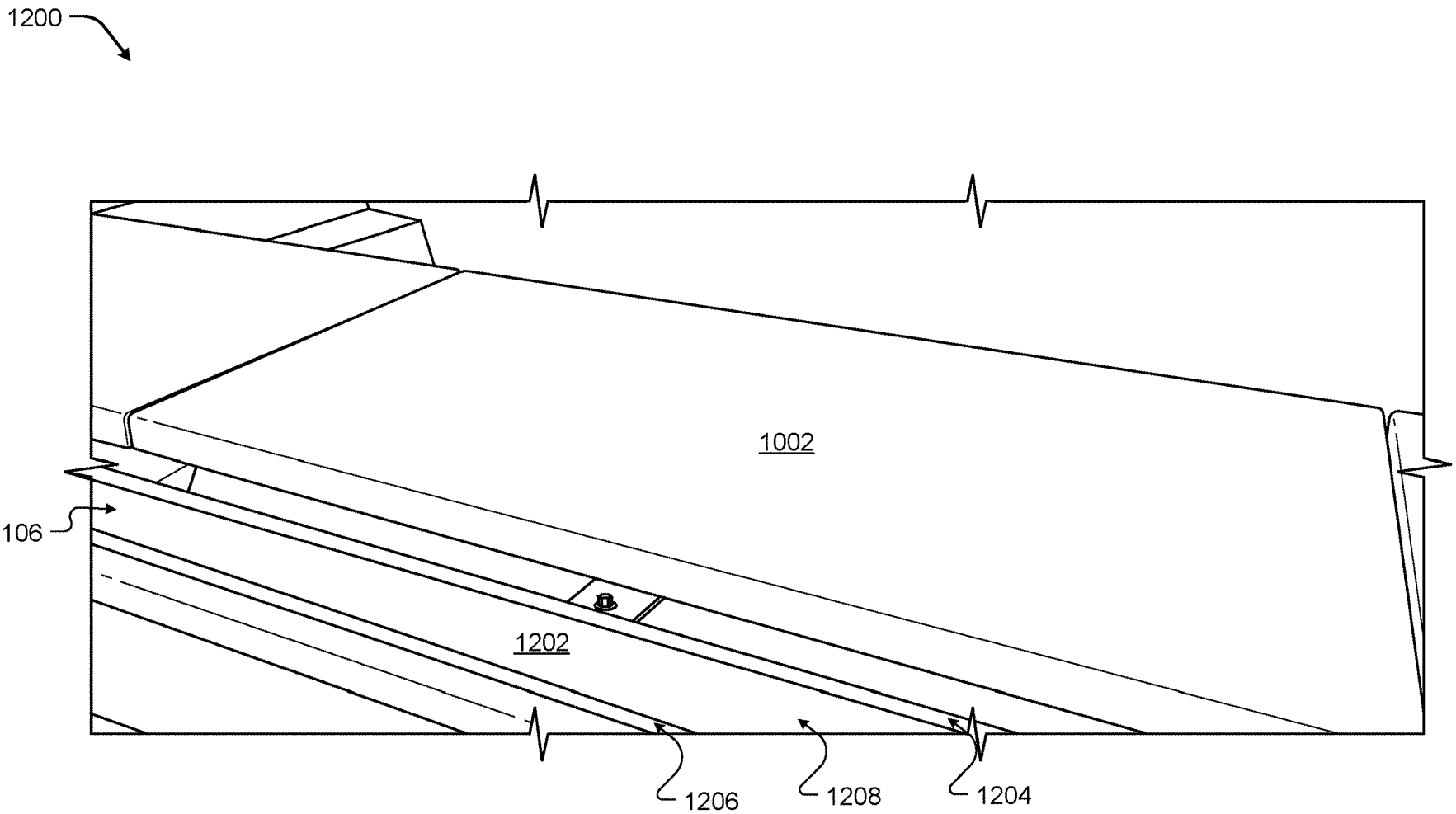
FIG. 12 is a pictorial view of a rail associated with the deck cover of FIG. 1 in accordance with embodiments of the disclosure.

FIG. 12 is a pictorial view 1200 of a rail 106 associated with the deck cover of FIG. 1 in accordance with embodiments of the disclosure. In the illustrated example, the rail or track 106 is coupled to a vertical surface of the pool basin and adjacent to the coping 1002. In this example, the rail or track 106 extends outward from the coping 1002. The rail 106 also includes a groove section or interior section 1202 between a top wall 1204, a bottom wall 1206, and a side wall 1208. The groove 1202 may be configured to receive one or more wheels associated with the panel such that the wheels move along the rail 106 and remain engaged with the rail 106 based at least in part on support from the top wall 1204, the bottom wall 1206, and the side wall 1208.

Figure 13:
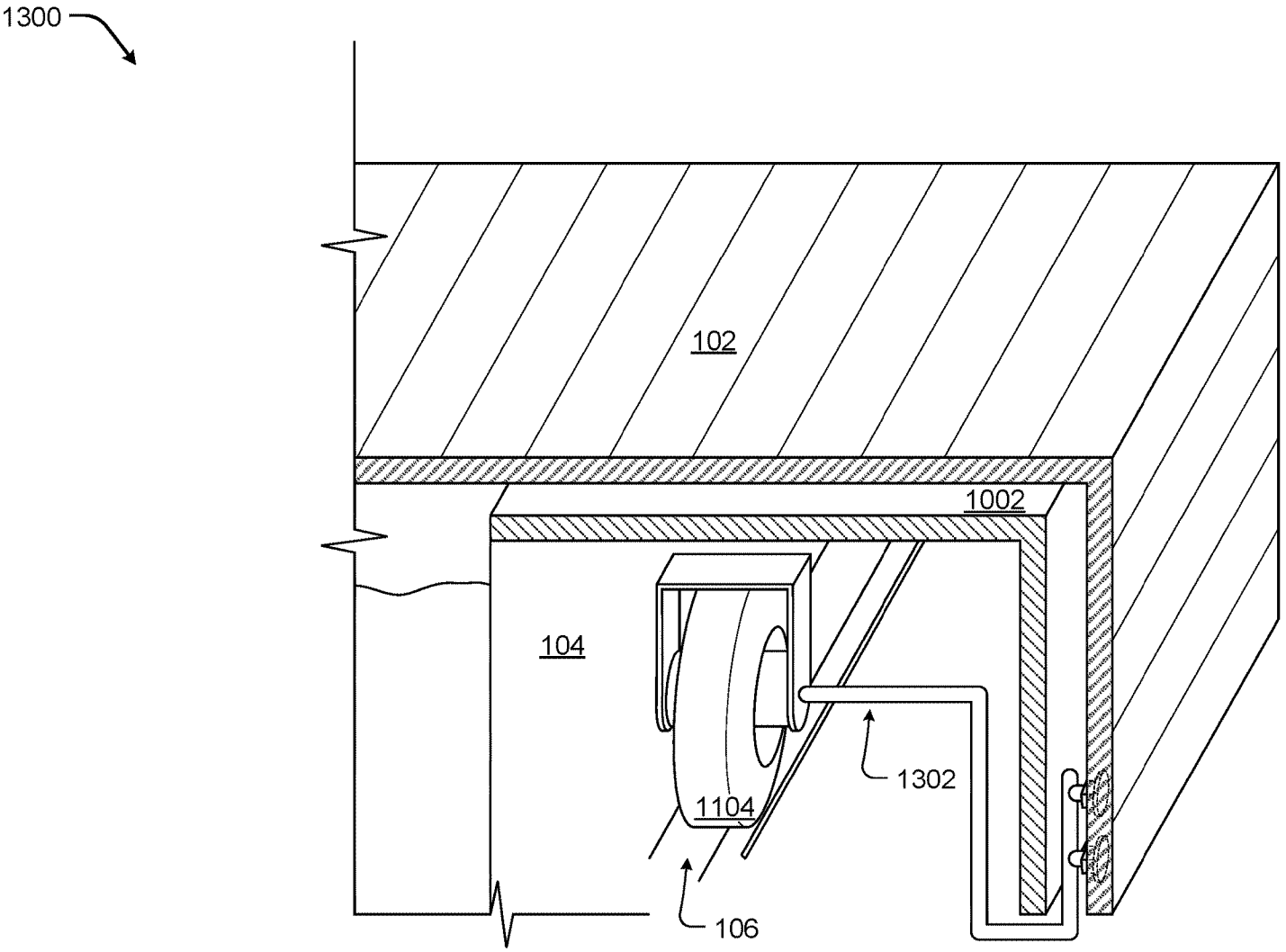
FIG. 13 is a pictorial view of a rail associated with the deck cover of FIG. 1 in accordance with embodiments of the disclosure.

FIG. 13 is a pictorial view 1300 of a rail 106 associated with the deck cover of FIG. 1 in accordance with embodiments of the disclosure. The rail 106 is positioned adjacent to the pool basin 104 and under the coping 1002. In this example, the coping 1002 incudes a top surface and a partial side surface that cover the rail 106 to prevent, for instance, an individual from stepping on the rail 106 and hurting themselves. In this manner, the coping 1002 may be configured to hid or protect the rail 106 from the outside environment.

In this example, the wheel 1104 may be mechanically or physically coupled to the panel 102 via a coupling member 1302. In this example, the coupling member 1302 is bent to travel under the coping 1002 to physically couple to the panel 102. However, it should be understood that in other examples, the wheel 1104 may be coupled to the panel 102 in various ways. In this example, the rail 106 includes an inverted triangular shape such that the wheel rests within the two sides of the tringle.

Figure 14:
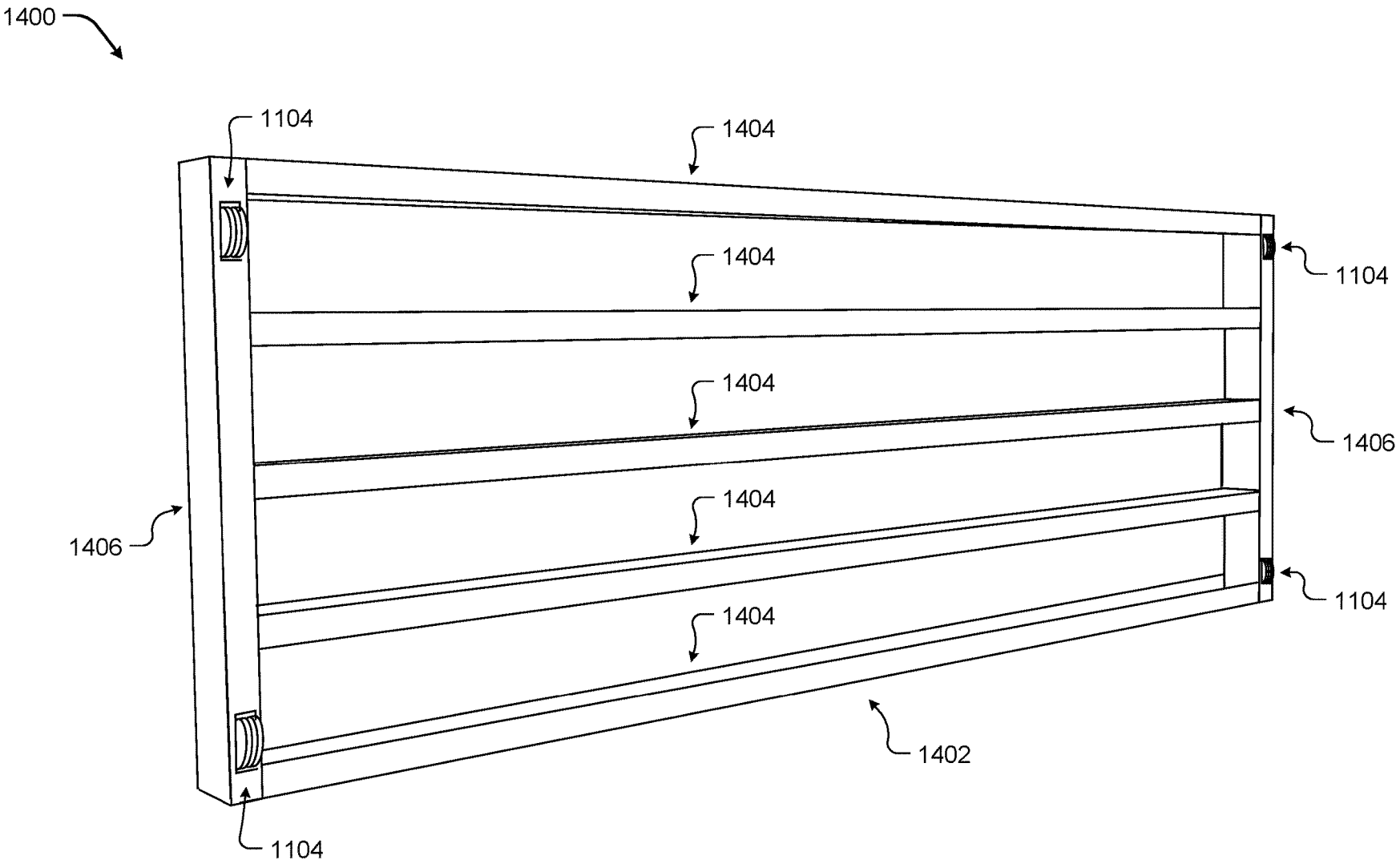
FIG. 14 is a pictorial view of a substructure associated with the deck cover of FIG. 1 in accordance with embodiments of the disclosure.

FIG. 14 is a pictorial view 1400 of a substructure 1402 associated with the deck cover of FIG. 1 in accordance with embodiments of the disclosure. In the current example, the substructure 1402 may be configured to support the weight of the panels, furniture, individuals, or other objects on the panels. The substructure 1402 may be formed from aluminum or other materials with sufficient rigidity to support the panel as well as objects on the panels. In some cases, the substructure 1402 may include a plurality of joists 1404 spaced apart by less than 4 inches. In other examples, the joists 1404 may be spaced apart by less than 6 inches. In other examples, the joists 1404 may be spaced apart by less than 8 inches. In other examples, the joists 1404 may be spaced apart by less than or equal to 12 inches.

In the current example, the substructure 1402 may also include wheels or casters 1104 integrated into the bottom surface of the side joists 1406. In some cases, the side joists 1406 may include multiple adjacent wheels 1104, such as three adjacent wheels at each wheel location. In other cases, the side joists 1406 may include between two adjacent wheels and five adjacent wheels at each wheel location.

In various examples, the panels including the substructure 1402 may have a tensile strength of 42,000 pounds per square inch and a yield strength of 35,00 pounds per square inch.

In the illustrated example, the side joists 1406 as well as the front and back joists may form the exterior surface wall of the panel. For instance, the outward facing surfaces of the side joists 1406 as well as the front and back joists may be formed from, clad in, or otherwise covered by material of the top surface of the panel (e.g., wood injected with vinegar, plastic, or other water-resistant material).

Figure 15:
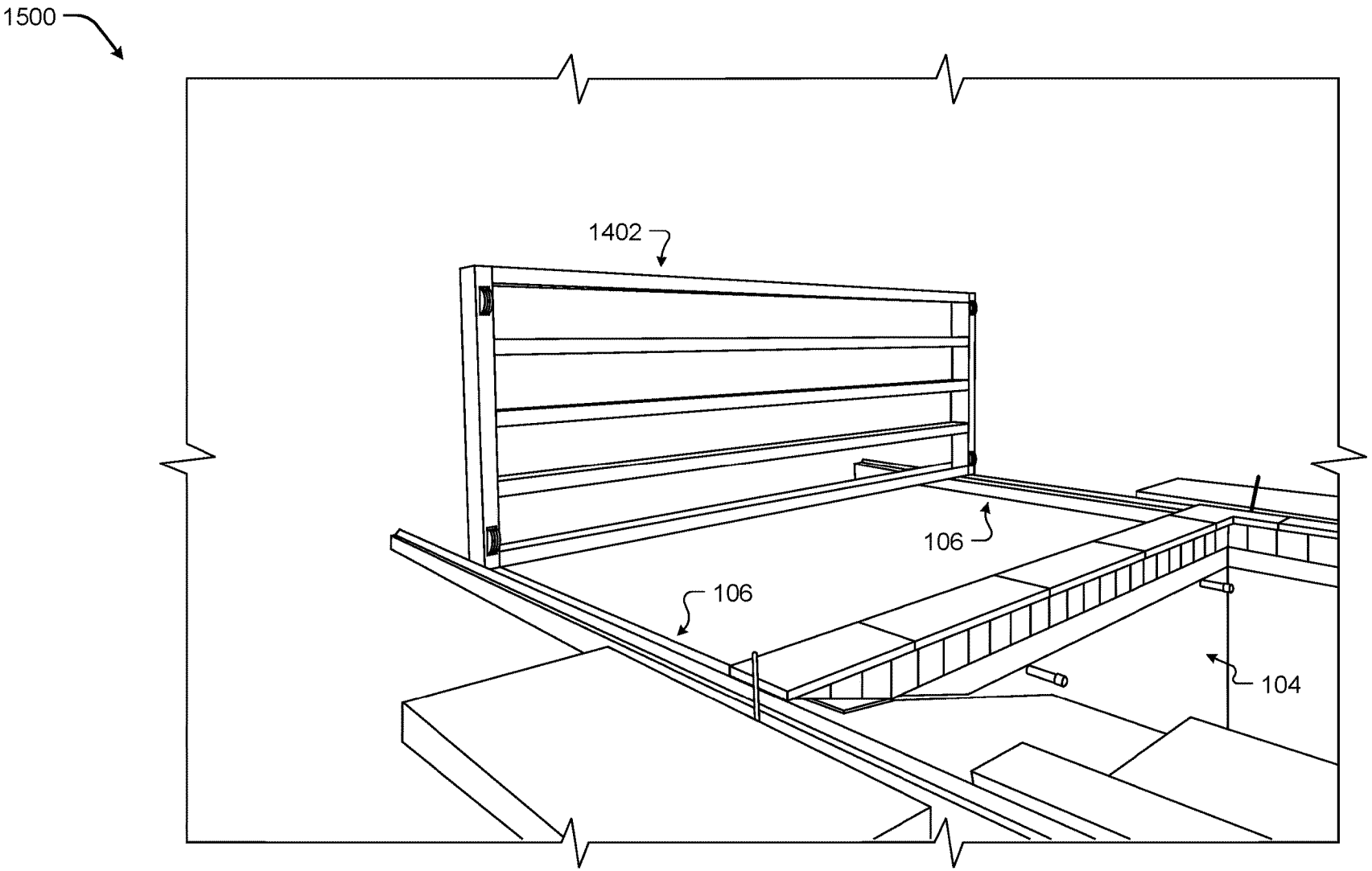
FIG. 15 is a pictorial view of a substructure associated with the deck cover of FIG. 1 removed from the rail in accordance with embodiments of the disclosure.

FIG. 15 is a pictorial view 1500 of a substructure 1402 associated with the deck cover of FIG. 1 removed from the rail 106 in accordance with embodiments of the disclosure. For instance, the substructure 1402 may be manufactured or fabricated as a single unit or component, including the integrated wheels. The substructure 1402 may then be transported to the location of the pool basin 104 and set or installed directly onto the rails 106.

FIGS. 1-15 illustrate various examples associated with a retractable cover or deck system for a pool. It should be understood that while each of the implementations 100-1500 may vary that the various components of each FIG. 1-15 may be used in conjunction with each other. For example, in some cases the slidable plane 102 of FIGS. 1-3 may be paired with the stackable panel 102 of FIG. 4 (e.g., a first panel may be slidable while a second panel may be stackable). In another example the motorized system of FIG. 4 may be used in conjunction with the slidable panels of FIGS. 1-3 and 4-X. In still other examples, the panels of FIGS. 1 and 3-13 may include the locking or mating members shown in FIG. 2, or below in FIGS. 16-19. Thus, the examples of FIGS. 1-15 illustrate various features of a retractable deck cover system that may be used in combination with each other.

Figure 16:
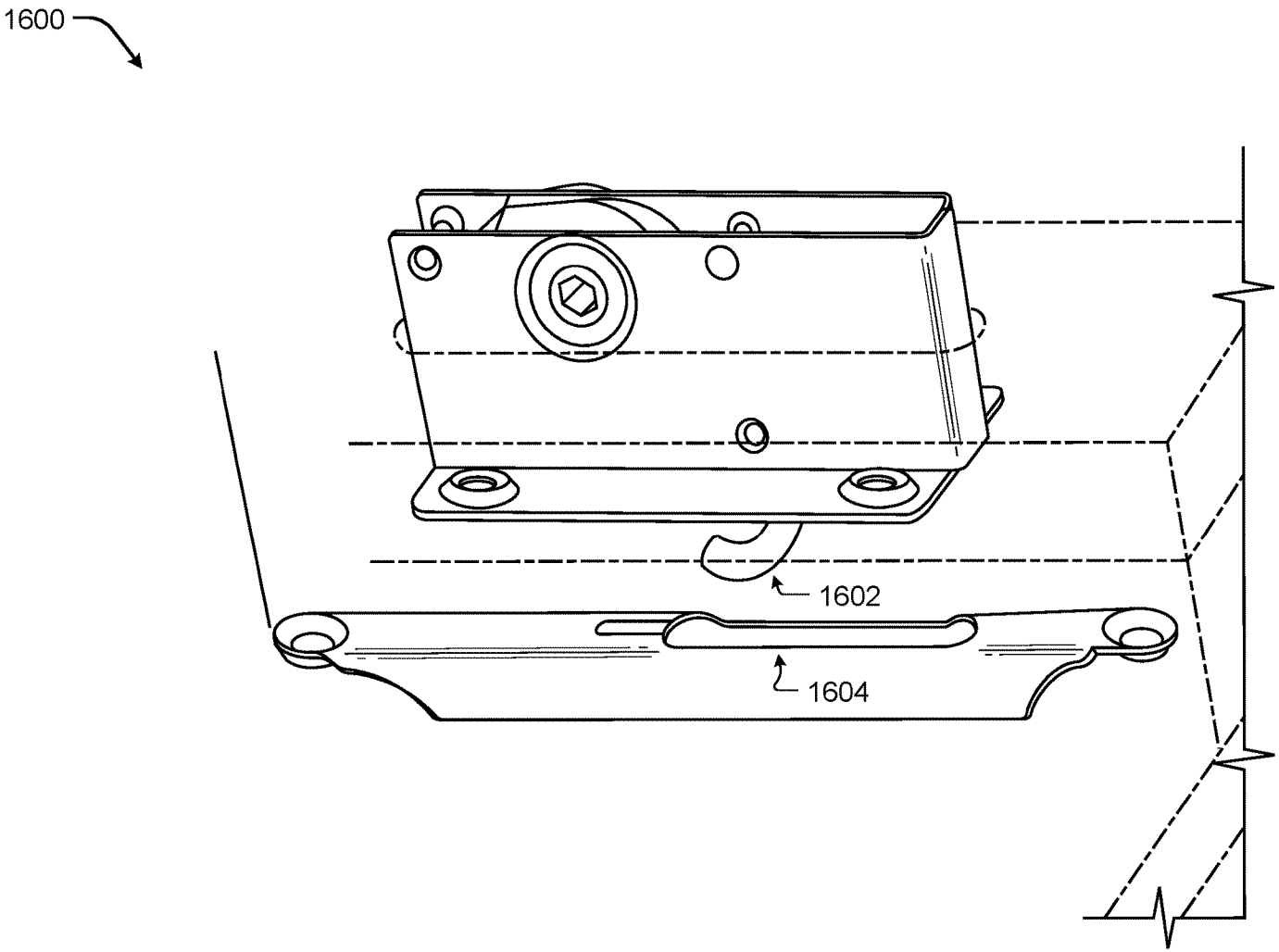
FIG. 16 is a pictorial view of a locking mechanism associated with the deck cover of FIG. 1 in accordance with embodiments of the disclosure.

FIG. 16 is a pictorial view 1600 of a locking mechanism associated with the deck cover of FIG. 1 in accordance with embodiments of the disclosure. In the current example, the male locking member 1602 may be coupled to the substructure 1402, as shown above in FIGS. 14 and 15. The male locking member 1602 may be configured to couple to a female locking member 1604 when the panel is in the closed position. In this current example, the locking mechanism maybe positioned out of sight under the panel of the deck or cover.

Figure 17:
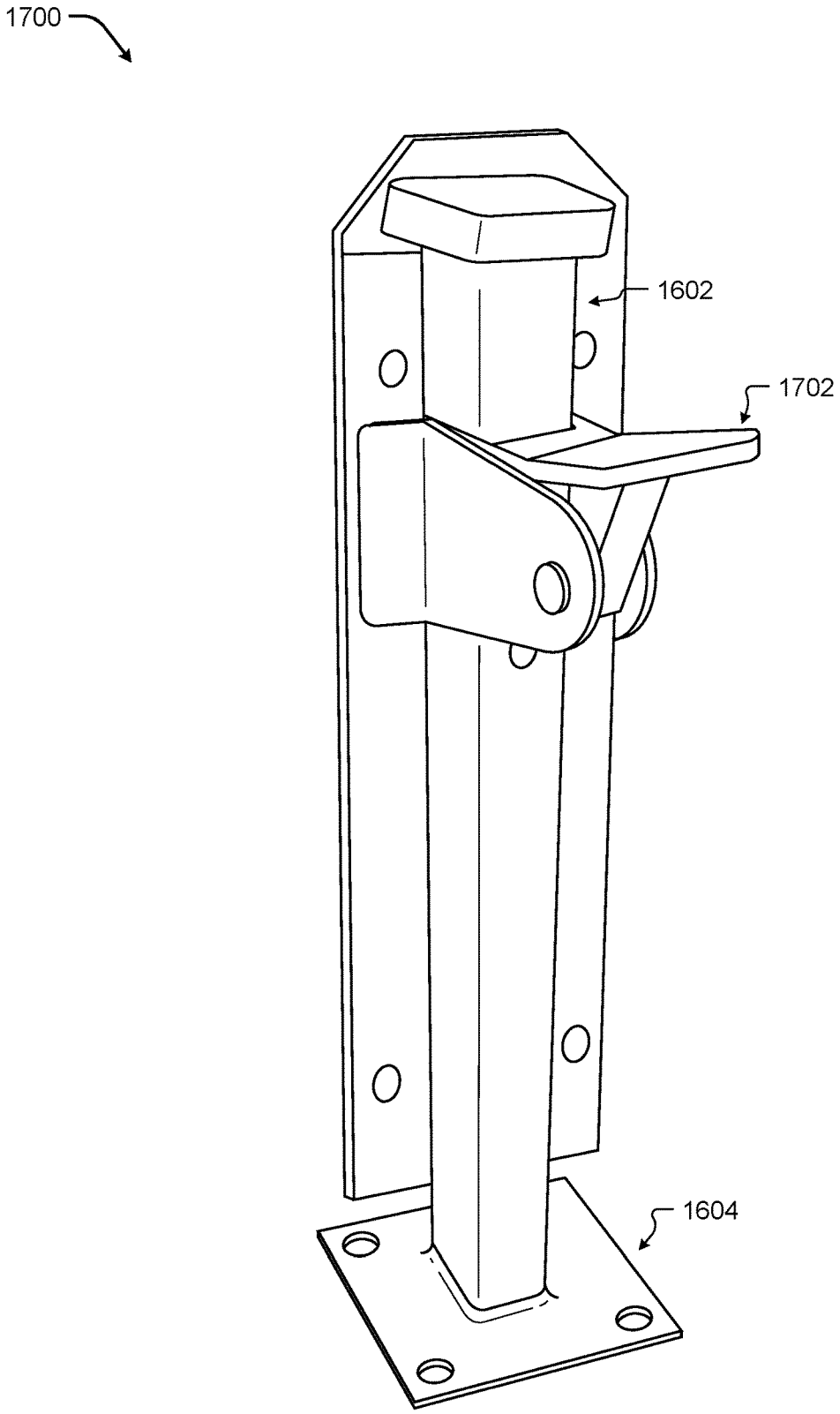
FIG. 17 is a pictorial view of a locking mechanism associated with the deck cover of FIG. 1 in accordance with embodiments of the disclosure.

FIG. 17 is a pictorial view 1700 of a locking mechanism associated with the deck cover of FIG. 1 in accordance with embodiments of the disclosure. In this example, the locking mechanism may be secured to a side surface of the panel or substructure via one or more bolts. The male locking mechanism 1602 may engage with the female locking mechanism 1604 when the panel is in the closed positioned using the foot or toe press 1702 to cause the male locking member 1602 to lower into the female locking member 1604 which may also be secured to a footing (such as a cement footing) via one or more bolts.

Figure 18:
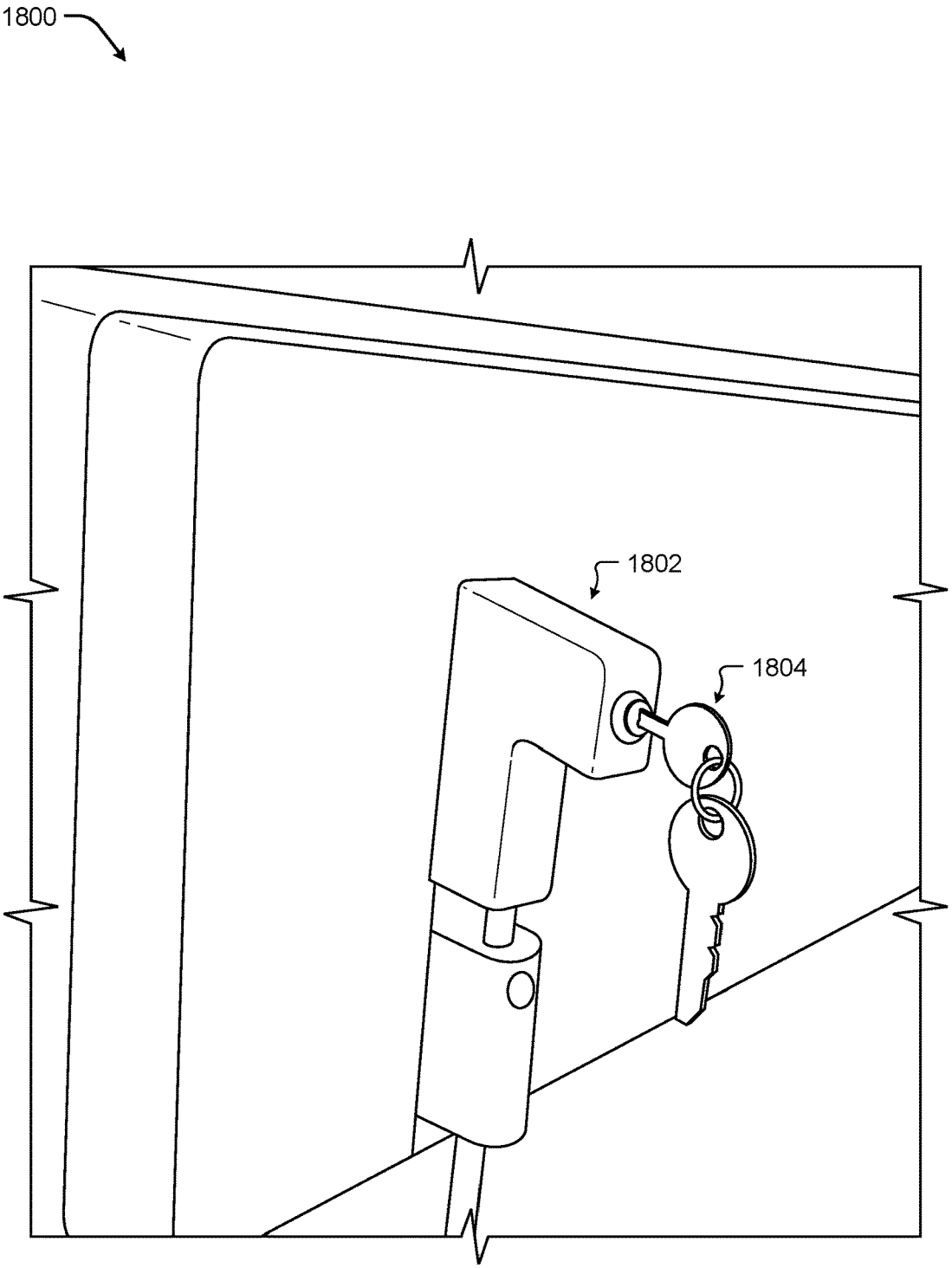
FIG. 18 is a pictorial view of a locking mechanism associated with the deck cover of FIG. 1 in accordance with embodiments of the disclosure.

FIG. 18 is a pictorial view 1800 of a locking mechanism 1802 associated with the deck cover of FIG. 1 in accordance with embodiments of the disclosure. In this example, the locking mechanism is similar to the mechanism of view 1700 however, the locking mechanism may be secured via a key 1804. It should be understood, that while the locking mechanism 1802 is illustrated with a key 1804, other types of security systems may be used, such as a push code, wirelessly controlled lock, and the like. (Your font went up a size starting at 0062).

Figure 19:
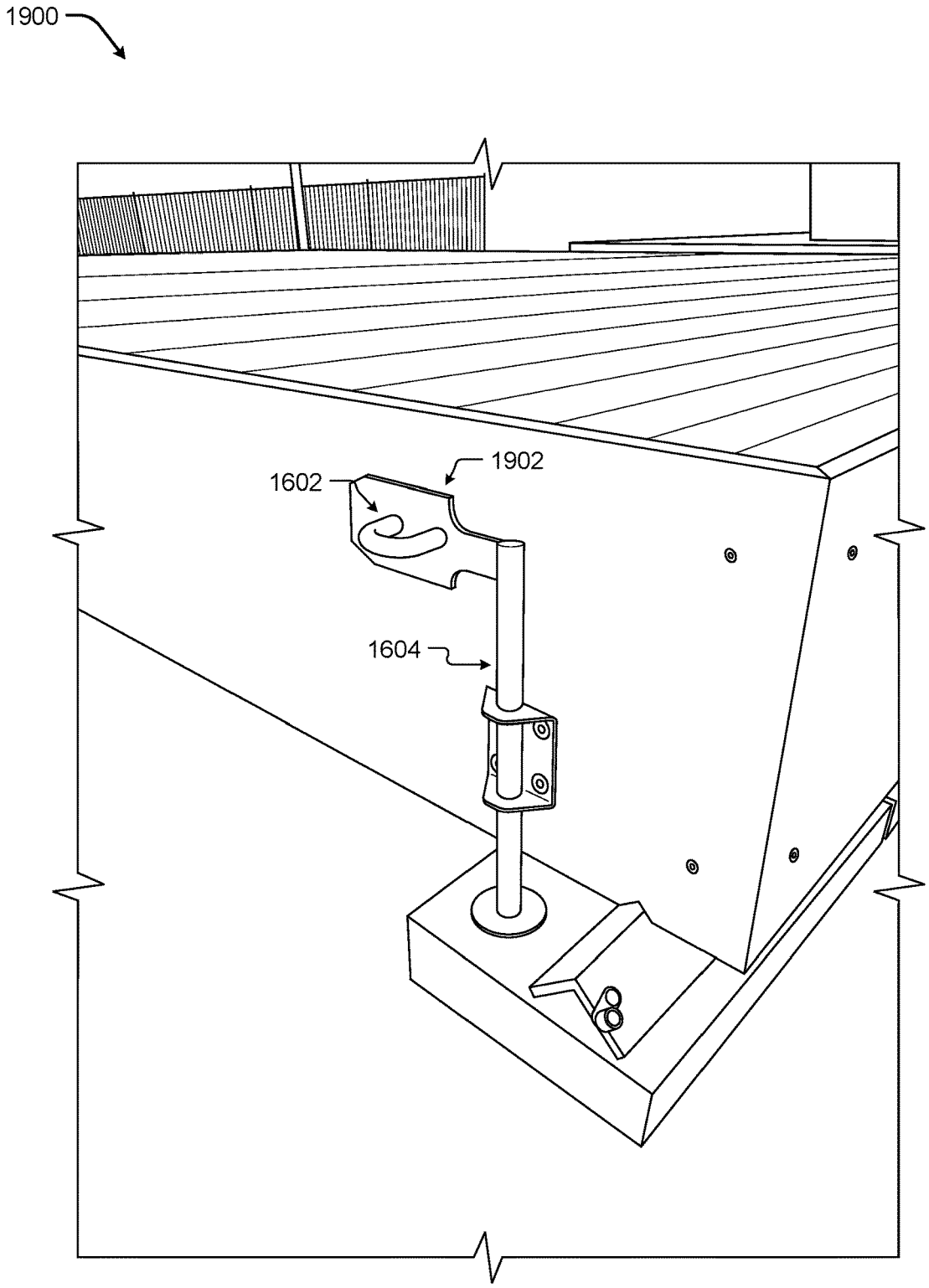
FIG. 19 is a pictorial view of a locking mechanism associated with the deck cover of FIG. 1 in accordance with embodiments of the disclosure.

FIG. 19 is a pictorial view 1900 of a locking mechanism associated with the deck cover of FIG. 1 in accordance with embodiments of the disclosure. Similar to the examples above, the locking mechanism may include a male locking mechanism 1602 and a female locking mechanism 1604. In this example, the locking mechanism may also include a latch 1902 that may be locked, with, for instance, a pad lock.

Figure 20:
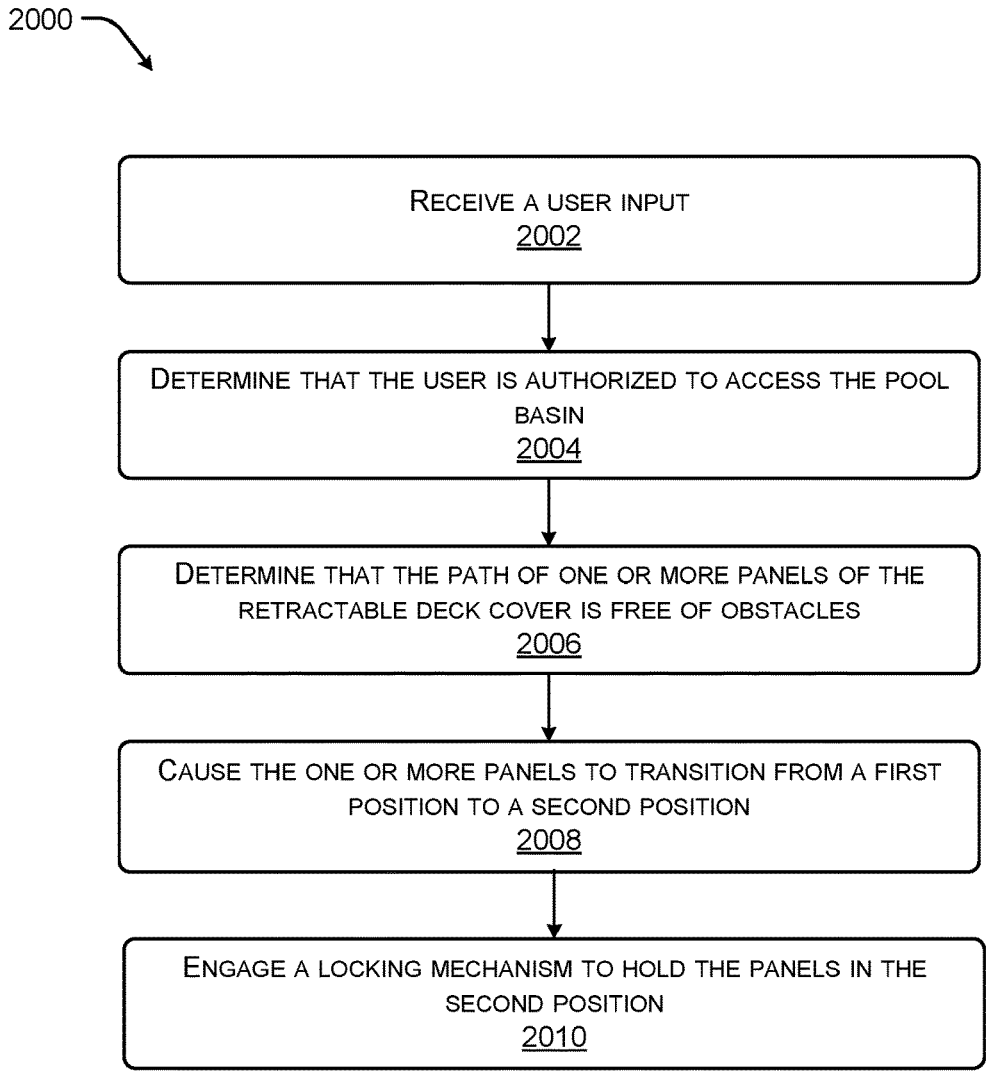
FIG. 20 illustrates an example flow diagram showing a process for controlling the panels of the deck cover of FIGS. 1-19 according to some implementations.
Figure 21:
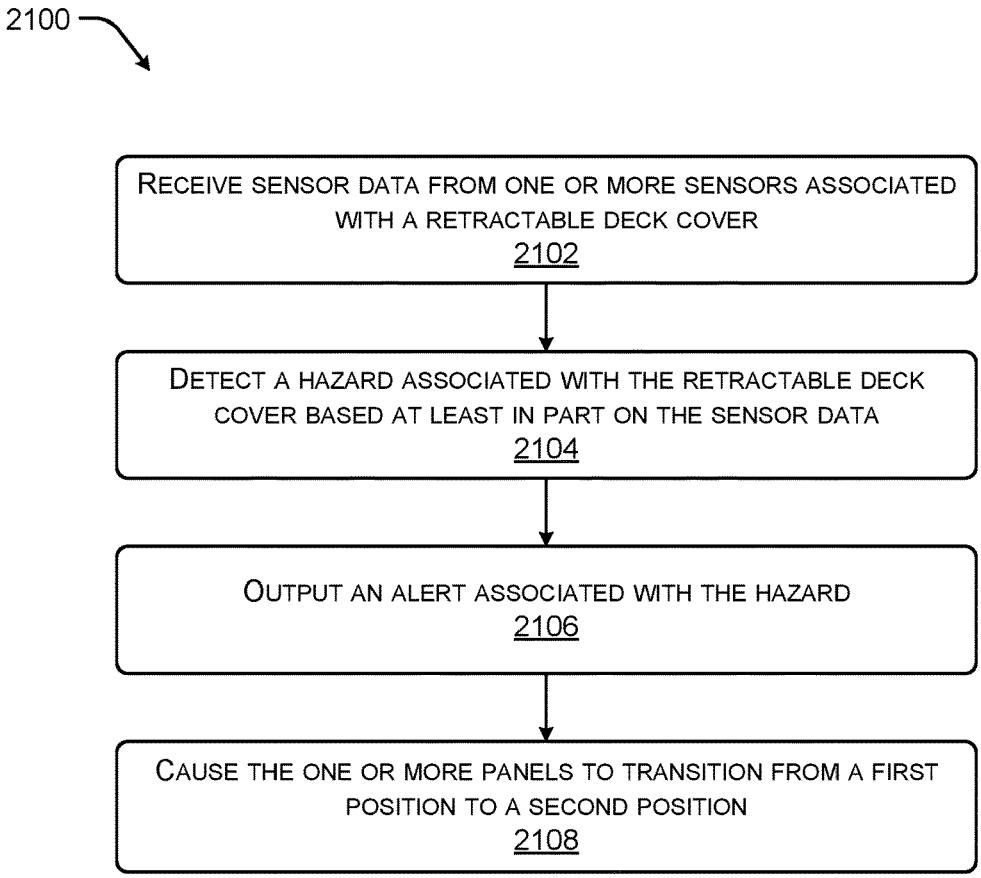
FIG. 21 illustrates an example flow diagram showing a process associated with electronic safety features of the deck cover of FIGS. 1-19 according to some implementations.

FIGS. 20 and 21 are flow diagrams illustrating example processes associated with a retractable deck cover according to some implementations. The processes are illustrated as a collection of blocks in a logical flow diagram, which represent a sequence of operations, some or all of which can be implemented in hardware, software or a combination thereof. In the context of software, the blocks represent computer-executable instructions stored on one or more computer-readable media that, which when executed by one or more processors, perform the recited operations. Generally, computer-executable instructions include routines, programs, objects, components, encryption, deciphering, compressing, recording, data structures and the like that perform particular functions or implement particular abstract data types.

The order in which the operations are described should not be construed as a limitation. Any number of the described blocks can be combined in any order and/or in parallel to implement the process, or alternative processes, and not all of the blocks need be executed. For discussion purposes, the processes herein are described with reference to the frameworks, architectures and environments described in the examples herein, although the processes may be implemented in a wide variety of other frameworks, architectures or environments.

FIG. 20 illustrates an example flow diagram showing a process 2000 for controlling the panels of the deck cover of FIGS. 1-19 according to some implementations. As discussed above, a system including a retractable and ridged deck cover may be used to enclosure a pool basin when in a closed position such that individuals and objects may traverse the deck cover or others stand top the deck cover. In some cases, the retractable deck cover may include one or more retractable panels.

At 2002, a control system of the deck cover may receive an input. For example, the user input may be received via a control panel (such as one or more input devices, buttons, levels, touch sensitive panel, and the like) associated or otherwise electorally coupled to the control system and the one or more panels of the retractable deck cover. In other examples, the user input may be received as a wireless communication from, for instance, a smart phone, tablet, remote control, or other user electronic device (e.g., as part on a downloadable application hosted on the user electronic device). For instance, the control system may include one or more communication interfaces configured to facilitate communication between one or more networks, one or more cloud-based management system, and/or one or more physical objects, such as controller or user electronic device. The communication interfaces may also facilitate communication between one or more wireless access points, a master device, and/or one or more other computing devices as part of an ad-hoc or home network system. The communication interfaces may support both wired and wireless connection to various networks, such as cellular networks, radio, WiFi networks, short-range or near-field networks (e.g., Bluetooth®), infrared signals, local area networks, wide area networks, the Internet, and so forth.

At 2004, the control system may determine that the user is authorized to access the pool basin. For instance, the user input may include a passcode, password, or electronic key that the control system may decode and compare to a stored passcode, password, or electronic key. In some cases, upon determine passcode, password, or electronic key is acceptable, the control system may cause the panels of the deck cover to unlock or otherwise release, such that the panels may move freely along the tracks or rails.

At 2006, the control system may determine if the path of the one or more panels is free from obstacles. For instance, the control system may be in electronic communication (such as wired or wireless communication) with one or more sensors, image devices, and the like. The control system may receive sensor data from the sensors and/or image devices and analyze the sensor data to detect objects within the path of the panels. In the case the path is clear from obstacles, the process 2000 may advance to 2008. Otherwise, the control system may halt the process 2000 until the control system determines that the path is clear or an override is received from an authorized user.

At 2008, the control system may cause the one or more panels to transition from a first position to a second position. For example, the one or more panels may transition from a closed position to an open position or, alternatively, form the closed position to the open position. In some cases, a chain, hydraulic, or other mechanism for transition the panels may be activated by the control system.

At 2010, the control system may engage a locking mechanism to cause the panels to lock or otherwise remain in the second position. In this manner, the panels may be secured while individuals access the pool as well as when individuals traverse over the deck surface.

FIG. 21 illustrates an example flow diagram showing a process 2100 associated with electronic safety features of the deck cover of FIGS. 1-19 according to some implementations. As discussed above, a system including a retractable and ridged deck cover may be used to enclosure a pool basin to increase the overall safety associated with owning a pool. In some cases, the retractable deck cover may include one or more retractable panels.

At 2102, a control system may receive sensor data form one or more sensor associated with the retractable deck cover. For instance, the sensors may be positioned at various locations both external to the deck cover (e.g., capturing data associate with the external environment) and internal to the deck cover (e.g., capturing data associated with the water of the pool or the space below the deck cover when the deck cover is in the closed position).

In at least some examples, the sensor may include motion sensors, inertial sensors (e.g., inertial measurement units (IMUs), accelerometers, magnetometers, gyroscopes, etc.), lidar sensors, radar sensors, sonar sensors, infrared sensors, cameras (e.g., RGB, IR, intensity, depth, etc.), microphone sensors, environmental sensors (e.g., temperature sensors, humidity sensors, light sensors, pressure sensors, etc.), ultrasonic transducers, and the like. In some examples, the sensor may include multiple instances of each type of sensors. As another example, camera sensors may include multiple cameras.

At 2104, the control system may detect a hazard associated with the retractable deck cover based at least in part on the sensor data. For example, the control system may process the sensor data to detect for instance the presence of an object (such as an individual) within the water of the pool basin when the panels of the deck cover are in the closed position. In another example, the control system may determine the total weight on one or more of the panels of the deck cover exceeds a threshold capacity.

At 2106, the control panel may output an alert associated with the hazard. For instance, the control panel may cause one or more speakers associated with the deck cover to output an audio alert that may alert nearby individuals to the hazard. In other cases, the alert may be provided via the one or more wireless communication channels to a user, such as via an application on an electronic device associated with the user.

At 2108, the control system may cause the one or more panels to transition from a first position to a second position. For example, the one or more panels may transition from a closed position to an open position to allow access to the object within the pool basin. While one or more examples of the techniques described herein have been described, various alterations, additions, permutations and equivalents thereof are included within the scope of the techniques described herein. As can be understood, the components discussed herein are described as divided for illustrative purposes. However, the operations performed by the various components can be combined or performed in any other component. It should also be understood, that components or steps discussed with respect to one example or implementation may be used in conjunction with components or steps of other examples.

In the description of examples, reference is made to the accompanying drawings that form a part hereof, which show by way of illustration specific examples of the claimed subject matter. It is to be understood that other examples can be used and that changes or alterations, such as structural changes, can be made. Such examples, changes or alterations are not necessarily departures from the scope with respect to the intended claimed subject matter. While the steps herein may be presented in a certain order, in some cases the ordering may be changed so that certain inputs are provided at different times or in a different order without changing the function of the systems and methods described. The disclosed procedures could also be executed in different orders. Additionally, various computations that are herein need not be performed in the order disclosed, and other examples using alternative orderings of the computations could be readily implemented. In addition to being reordered, the computations could also be decomposed into sub-computations with the same results.

A. An system comprising a pool basin; a first rail positioned adjacent to at least one first side of the pool basin; a first panel of a retractable deck cover coupled to the first rail via one or more wheels, the first panel configured to transition along the rail between an open position and a closed position, wherein the pool basin is at least partially covered by the first panel in the closed position and exposed to a physical environment when the first panel is in the open position; and wherein a top surface of the first panel is substantially ridged and configured to support greater than 400 pounds.

B. The system of claim A, further comprises a second panel of the retractable deck cover coupled to the first rail via one or more wheels, the second panel configured to transition along the rail between an open position and a closed position, wherein the pool basin is at least partially covered by the second panel in the closed position and exposed to the physical environment when the second panel is in the open position.

C. The system of claim A, wherein the second panel is configured to mate with the first panel when the second panel and the first panel are in the closed position.

D. The system of claim A, further comprising a second rail positioned adjacent to a least one second side of the pool basin, the second side opposite the first side; and wherein the first panel is coupled to the second rail via one or more additional wheels.

E. The system of claim A, wherein the first panel includes a plurality of planks and wherein gaps between individual planks of the plurality of planks are sealed via a curable material.

F. The system of claim A, wherein the first panel includes a water-resistant substructure, the water-resistant substructure including at least two side walls and at least one joist coupled to the at least two side walls; and one or more water-resistant planks positioned along a top surface of the water-resistant substructure.

G. The system of claim F, further comprising at least one sensor coupled to the first panel or the substructure to capture data associated with water within the pool basin when the first panel is in the closed position; one or more processors; and one or more computer-readable media storing instructions which when executed by the one or more processors to cause the one or more processors to perform the following operations: determine that the at least one object is within the pool basin; and generate, in response to determine the object is within the pool basin, an alert to notify an individual to the presence of the object.

H. The system of claim A, further comprising a locking mechanism to lock the first panel in the close position.

I. The system of claim A, wherein the first panel includes a plurality of planks and wherein gaps between individual planks of the plurality of planks are less than ⅛ of an inch.

J. A retractable deck cover comprising a first rail positioned adjacent to at least one first side of a pool basin; a first substructure having at least one wheel integral to the substructure and in physical contact with the first rail; and a first rigid panel supported by the first substructure and configured to transition along the rail together with the substructure between an open position and a closed position, wherein the pool basin is at least partially covered by the first panel in the closed position and exposed to a physical environment when the first panel is in the open position.

K. The retractable deck cover of claim J, further comprises a mechanism to assist a user with opening and closing the first rigid panel, the mechanism extends upward and above a top surface of the first rigid panel.

L. The retractable deck cover of claim K, wherein the mechanism is coupled to the top surface of the panel at a first end and includes an umbrella awning at the second end.

M. The retractable deck cover of claim I, further comprising a second rail positioned adjacent to a least one second side of the pool basin, the second side adjacent to the first side; and wherein first substructure has at least one second wheel integral to the substructure and in physical contact with the second rail.

N. The retractable deck cover of claim J, wherein the first rigid panel includes at least two sections that stack when the first rigid panel is in the open position.

O. The retractable deck cover of claim J, wherein the first rail is at least partially covered by coping associated with the pool basin.

P. The retractable deck cover of claim J, further comprising a locking mechanism to lock the first panel in the open position.

Q. The retractable deck cover of claim J, wherein the first rail is substantially triangular in shape and the at least one wheel includes a groove to receive a top portion of the triangular shaped first rail.

R. A retractable deck cover for a pool comprising at least one panel having a plurality of planks configured to support greater than or equal to 300 pounds and having an open position and a closed positioned, the at least one panel to expose a watery surface when in the open position and to cover the watery surface when in the closed position, individual planks of the plurality of planks sealed together via a curable material.

S. The retractable deck cover of claim R, wherein the at least one panel reduces water evaporation of the watery surface by at least 75% when in the closed positioned with respect to the water surface when the at least one panel is in the open position.

T. The retractable deck cover of claim R, further comprising at least one sensor coupled to a first panel of the at least one panel to capture data associated with an amount of weight being supported by the first panel; one or more processors; and one or more computer-readable media storing instructions which when executed by the one or more processors to cause the one or more processors to perform the following operations: determine that the amount of weight being supported by the first panel exceeds or meets a first threshold; generate, in response to determine the amount of weight exceeds or meets he first threshold, a first alert to notify an individual in physical proximity to the first panel that the first threshold has been exceeded or met; determine that the amount of weight being supported by the first panel exceeds or meets a second threshold; and generate, in response to determine the amount of weight exceeds or meets he first threshold, a second alert to notify the individual in physical proximity to the first panel that the second threshold has been exceeded or met, the second alert different than the first alert.

U. The retractable deck cover of claim R, wherein the at least one panel includes four or more panels.

While the example clauses described above are described with respect to one particular implementation, it should be understood that, in the context of this document, the content of the example clauses can also be implemented via a method, device, system, a computer-readable medium, and/or another implementation. Additionally, any of examples A-U may be implemented alone or in combination with any other one or more of the examples A-U.

What is claimed is:

1. A retractable deck cover comprising:

a first rail positioned adjacent to at least one first side of a pool basin;

a first substructure having a front joist, a back joist, and a plurality of interior joists suspended between a first side joist and a second side joist and at least one wheel integral to the first side joist of the substructure and in physical contact with the first rail, the first side joist and the second side joist arranged perpendicular to the front joist, the back joist, and the plurality of interior joists; and a first rigid panel supported by the first substructure and configured to transition along the rail together with the substructure between an open position and a closed position, wherein the pool basin is at least partially covered by the first panel in the closed position and exposed to a physical environment when the first panel is in the open position; and a mechanism to assist a user with opening and closing the first rigid panel, the mechanism extends upward and above a top surface of the first rigid panel and wherein the mechanism is coupled to the top surface of the panel at a first end and includes an umbrella awning at the second end.

2. The retractable deck cover as recited in claim 1, further comprising:

a second rail positioned adjacent to a least one second side of the pool basin, the second side adjacent to the first side; and wherein first substructure has at least one second wheel integral to the substructure and in physical contact with the second rail.

3. The retractable deck cover as recited in claim 1, wherein the first rigid panel includes at least two sections that stack when the first rigid panel is in the open position.

4. The retractable deck cover as recited in claim 1, wherein the first rail is substantially triangular in shape and the at least one wheel includes a groove to receive a top portion of the triangular shaped first rail.

5. The retractable deck cover as recited in claim 1, wherein the first rail is at least partially covered by coping associated with the pool basin.

6. The retractable deck cover as recited in claim 1, further the first rigid panel is substantially horizontal in the closed position and is rotated by at least 75 degrees from the horizontal when in the open position.

7. A retractable deck cover comprising:

a first rail positioned adjacent to at least one first side of a pool basin;

a first panel coupled to the first rail via one or more wheels, the first panel configured to transition in a first direction along the rail between an open position and a closed position, wherein the pool basin is at least partially covered by the first panel in the closed position and exposed to a physical environment when the first panel is in the open position;

a second panel coupled to the first rail via one or more wheels, the second panel configured to transition in a second direction along the rail between an open position and a closed position, wherein the pool basin is at least partially covered by the second panel in the closed position and exposed to the physical environment when the second panel is in the open position, the second direction opposite the first direction;

at least one sensor coupled to the first panel to capture data associated with water within the pool basin when the first panel is in the closed position;

one or more processors; and one or more computer-readable media storing instructions which when executed by the one or more processors to cause the one or more processors to perform the following operations:

determine that at least one object is within the pool basin; and generate, in response to determining the object is within the pool basin, an alert to notify an individual to the presence of the object; and wherein a top surface of the first panel is substantially ridged and configured to support greater than 2000 pounds.

8. The retractable deck cover as recited in claim 7, wherein:

the second panel is configured to mate with the first panel when the second panel and the first panel are in the closed position; and a distance between a bottom surface of the first panel and a top surface of water within the pool basin is greater than 5 inches.

9. The retractable deck cover as recited in claim 7, further comprising:

a second rail positioned adjacent to a least one second side of the pool basin, the second side opposite the first side; and wherein the first panel is coupled to the second rail via one or more additional wheels.

10. The retractable deck cover as recited in claim 7, wherein the first panel includes a plurality of planks and wherein gaps between individual planks of the plurality of planks are less than ⅛ of an inch.

11. The retractable deck cover as recited in claim 7, wherein the first panel includes:

a water-resistant substructure, the water-resistant substructure including at least two side walls and at least one joist coupled to the at least two side walls; and one or more water-resistant planks positioned along a top surface of the water-resistant sub structure.

12. The retractable deck cover as recited in claim 7, further comprising a locking mechanism to lock the first panel in the close position.

13. A retractable deck cover comprising:

at least one panel having a plurality of planks configured to support greater than or equal to 2000 pounds and having an open position and a closed positioned, the at least one panel to expose a watery surface of a pool basin when in the open position and to cover the watery surface when in the closed position, a bottom surface of the plurality of planks greater than or equal to 3 inches above the coping when the at least one panel is in the closed position;

at least one sensor coupled to a first panel of the at least one panel to capture data associated with an amount of weight being supported by the first panel;

one or more processors; and one or more computer-readable media storing instructions which when executed by the one or more processors to cause the one or more processors to perform the following operations:

determine that the amount of weight being supported by the first panel exceeds or meets a first threshold;

generate, in response to determine the amount of weight exceeds or meets he first threshold, a first alert to notify an individual in physical proximity to the first panel that the first threshold has been exceeded or met;

determine that the amount of weight being supported by the first panel exceeds or meets a second threshold; and generate, in response to determine the amount of weight exceeds or meets he first threshold, a second alert to notify the individual in physical proximity to the first panel that the second threshold has been exceeded or met, the second alert different than the first alert.

14. The retractable deck cover as recited in claim 13, wherein the at least one panel includes four or more panels.

15. The system as recited in claim 13, wherein the at least one panel reduces water evaporation of the watery surface by at least 75% when in the closed positioned with respect to the water surface when the at least one panel is in the open position.

16. The retractable deck cover as recited in claim 1, further comprising:

at least one sensor coupled to the first rigid panel or the substructure to capture data associated with water within the pool basin when the first panel is in the closed position;

one or more processors; and one or more computer-readable media storing instructions which when executed by the one or more processors to cause the one or more processors to perform the following operations:

determine that the at least one object is within the pool basin; and generate, in response to determine the object is within the pool basin, an alert to notify an individual to the presence of the object.

17. The retractable deck cover as recited in claim 1, further comprises a locking mechanism to lock the first panel in the close position.

18. The retractable deck cover as recited in claim 7, further comprising a mechanism to assist a user with opening and closing the first panel, the mechanism coupled to a top surface at a first end, extends upward above the top surface of the first panel, and includes an umbrella awning at the second end.

19. The retractable deck cover as recited in claim 7, wherein the first rail is substantially triangular in shape.

20. The system as recited in claim 13, wherein the first alert and the second alert are audio alerts.

* * * * *